US007160049B2

(12) United States Patent
Saito et al.

(10) Patent No.: US 7,160,049 B2
(45) Date of Patent: Jan. 9, 2007

(54) PAVING MATERIAL FOR ABSORBING ELECTROMAGNETIC WAVE AND PAVEMENT STRUCTURE USING IT

(75) Inventors: Toshio Saito, Inzai (JP); Kenichi Harakawa, Inzai (JP); Yoshitaka Wakinaka, Inzai (JP); Takeshi Kunishima, Chuo-ku (JP); Kenichi Yoshimura, Chuo-ku (JP); Yoshifumi Fujii, Chuo-ku (JP); Shin-ichiro Andoh, Chuo-ku (JP); Takeo Iwata, Machida (JP); Masakazu Sato, Machida (JP)

(73) Assignees: Takenaka Corporation, Osaka (JP); Takenaka Road Construction Co., Ltd., Tokyo (JP); Takenaka Civil Engineering & Construction Co., Ltd., Tokyo (JP)

( * ) Notice: Subject to any disclaimer, the term of this patent is extended or adjusted under 35 U.S.C. 154(b) by 0 days.

(21) Appl. No.: 10/491,319

(22) PCT Filed: Sep. 28, 2001

(86) PCT No.: PCT/JP01/08532

§ 371 (c)(1),
(2), (4) Date: Jul. 27, 2004

(87) PCT Pub. No.: WO03/031722

PCT Pub. Date: Apr. 17, 2003

(65) Prior Publication Data

US 2005/0013661 A1 Jan. 20, 2005

(51) Int. Cl.
*E01C 7/22* (2006.01)
*E01C 7/00* (2006.01)

(52) U.S. Cl. ..... 404/17; 404/27; 404/71; 404/82

(58) Field of Classification Search ..... 404/17, 404/18, 22, 27, 28, 31, 32, 34, 71, 82
See application file for complete search history.

(56) References Cited

U.S. PATENT DOCUMENTS 5,081,455 A * 1/1992 Inui et al. ..... 342/1

(Continued)

FOREIGN PATENT DOCUMENTS

JP 62-21103 2/1987

(Continued)

OTHER PUBLICATIONS

"'Electromagnetic Wave Absorbing Paving' Developed As a Measure Against Road Electromagnetic Waves" by Takenaka Corporation dated Jun. 4, 2001 (available at http://www.takenaka.co.jp/takenaka_e/news_e/pr0106/m0106_01.htm).*

*Primary Examiner*—Raymond Addie
(74) *Attorney, Agent, or Firm*—Brown Raysman Millstein Felder & Steiner LLP

(57) ABSTRACT

An electromagnetic absorber formed of conductive fiber or the like, such as carbon fiber having an overall length corresponding to the wavelength of electromagnetic waves to be absorbed, is mixed into a base material to form an electromagnetic wave-absorbing pavement material. The electromagnetic wave-absorbing pavement material is used to form a pavement having an electromagnetic wave absorbing course. Further, an electromagnetic wave reflecting course is disposed under the electromagnetic wave absorbing course, and the electric length of the electromagnetic wave reflecting course is set to a predetermined value in relation to the dielectric constant so that electromagnetic waves reflecting off the surface of the electromagnetic wave absorbing course and electromagnetic waves reflecting off the electromagnetic wave reflecting course have opposite phases and thereby cancel each other out, whereby the electromagnetic waves are absorbed well.

16 Claims, 13 Drawing Sheets

U.S. PATENT DOCUMENTS

| | | | | |
|---|---|---|---|---|
| 5,976,666 | A * | 11/1999 | Narang et al. | 428/138 |
| 2002/0149493 | A1* | 10/2002 | Yudate et al. | 340/693.5 |
| 2003/0005759 | A1* | 1/2003 | Breed et al. | 73/146 |
| 2004/0037643 | A1* | 2/2004 | Naus et al. | 404/31 |
| 2004/0120765 | A1* | 6/2004 | Jones et al. | 404/35 |

FOREIGN PATENT DOCUMENTS

| | | |
|---|---|---|
| JP | A 62-268200 | 11/1987 |
| JP | 63305597 | 12/1988 |
| JP | 64-036804 | 2/1989 |
| JP | 64-082600 | 3/1989 |
| JP | 4001304 | 1/1992 |
| JP | 4163998 | 6/1992 |
| JP | 5327267 | 12/1993 |
| JP | 06-122568 | 5/1994 |
| JP | 10322080 | 12/1998 |
| JP | 11204985 | 7/1999 |
| JP | 2000138491 | 5/2000 |
| JP | 2001077586 | 3/2001 |

* cited by examiner

PAVING MATERIAL FOR ABSORBING ELECTROMAGNETIC WAVE AND PAVEMENT STRUCTURE USING IT

This application is a National Phase entry of PCT International Application, Ser. No. PCT/JP0108532 filed 28 Sep. 2001.

TECHNICAL FIELD

The present invention relates to an electromagnetic wave-absorbing pavement material, and a pavement using the same. The electromagnetic wave-absorbing pavement material serves to absorb unnecessary electromagnetic waves so as to prevent interference thereof in a place where electromagnetic waves are used for communication, detection or measurement.

BACKGROUND ART

Automatic toll collection systems (such as an Electric Toll Collection System, ETC) for toll roads and advanced cruise-assist highway systems (AHS) or smart cruise systems for automobiles traveling on roads have been developing as part of intelligent transport systems (ITS), road transport systems for the next generation.

The ETC is a system in which a toll is collected via radio communication between an automatic toll payment device (such as an IC card or a radio tag) mounted in an automobile and an automatic toll collection apparatus disposed at a tollgate, without stopping traffic on toll roads such as expressways. Implementation of the ETC is expected because the system not only facilitates toll payment but also has effects of mitigating traffic congestion, reducing personnel expenses, and the like.

In the ETC, a detection means such as radars of the automatic toll collection apparatus disposed at the tollgate detects that an automobile traveling on a road has approached the tollgate with a predetermined distance therebetween.

Subsequently, a radio communication device of the automatic toll collection apparatus transmits a signal to the traveling automobile and prompts the automatic toll payment device of the automobile to transmit, via radio communication, information (such as a type of vehicle, contract details, a paying account, and the like) which is necessary to determine a toll for the automobile. The automatic toll payment device of the automobile then transmits the information necessary to determine the toll for the automobile to the radio communication device of the automatic toll collection apparatus.

The automatic toll collection apparatus receives the information necessary to determine the toll for the automobile, calculates the toll based on a traveled distance of the automobile on the toll road, and executes a toll collection process.

Further, in the AHS, for example, a lane marker is provided at each of predetermined positions of a road along driving lanes for automobiles. A detector, such as a radar, of a cruise-assist device mounted in an automobile traveling on the road detects the position of the lane marker to detect an appropriate traveling route. In order to make the automobile travel on the appropriate traveling route, the driver of the automobile is warned of the possibility of deviation from the driving lane, or automatic intervention in the operation of a steering device of the automobile is performed for safe driving. Furthermore, various types of communications are carried out between communication equipment of the lane markers disposed on the road and the vehicle in order to determine the traveling route and improve transportation facilities.

Thus, in the above-described ETC and the AHS, which are part of the ITS, the traveling automobile is used as an object of communication, detection or measurement carried out by using electromagnetic waves of relatively high frequency. For this reason, the operation of communication, detection or measurement using electromagnetic waves of relatively high frequency needs to be carried out accurately the instant the traveling automobile passes through a predetermined place.

However, in the ETC or the AHS, unnecessary electromagnetic waves scatter due to the electromagnetic waves of relatively high frequency reflecting off the road or the like. The unnecessary scattered electromagnetic waves may be received by a receiver of the ETC or the AHS, which may cause errors in the operation of communication, detection or measurement.

Moreover, studies have been conducted in an attempt to shorten the term of construction and improve the quality of a pavement of a paved road by applying factory-prepared precast concrete to the pavement of road areas for the communication between stations of the ETC and automobiles, or the pavement of roads with lane markers for the AHS.

However, a conventional pavement with concrete slabs is formed of a material of high density and small porosity (so-called "dense and solid material"). Since this material has a dielectric constant larger than that of air, electromagnetic waves easily reflect off the surface of the concrete slab.

Moreover, because a large amount of electromagnetic waves reflect off the surface of the concrete slab, the electromagnetic waves cannot be transmitted to the inside of the concrete slab. For this reason, even with a pavement formed so as to absorb radio waves by mixing a dielectric material and a magnetic material into a concrete slab, a sufficient radio wave absorption effect cannot be obtained.

Further, when water accumulates on the surface of the concrete slab due to rain or the like, the amount of radio waves reflecting off the surface of the concrete slab becomes large.

Because of the aforementioned characteristics of the concrete slab, when the concrete slab is used to form the pavement of road areas for the communication between stations of the ETC and automobiles, or the pavement of roads with lane markers for the AHS, it is difficult for the pavement to efficiently absorb electromagnetic waves emitted from the system and suppress generation of unnecessary scattered electromagnetic waves.

In view of the above, in order to absorb electromagnetic waves and prevent generation of unnecessary scattered electromagnetic waves, a first object of the present invention is to provide a novel electromagnetic wave-absorbing pavement material having an electromagnetic wave absorption function. A second object of the present invention is to provide a novel pavement for a road constructed by using the electromagnetic wave-absorbing pavement material. A third object of the present invention is to provide a novel pavement in which a pavement slab formed with the electromagnetic wave-absorbing pavement material is used.

DISCLOSURE OF THE INVENTION

A first aspect of the present invention is an electromagnetic wave-absorbing pavement material formed by mixing conductive fiber into a base material, the conductive fiber having a length of at least 1/10 of the wavelength of electromagnetic waves to be absorbed, and an overall length of no more than 50 mm.

A second aspect of the present invention is an electromagnetic wave-absorbing pavement material, wherein the conductive fiber is mixed into the base material at a weight ratio of no more than 0.5% with respect to aggregate content mixed into the base material.

With the above structure, the electromagnetic wave-absorbing pavement material functions to well absorb electromagnetic waves having a frequency band used for communication, detection or measurement. Thus, when a structure is formed of the electromagnetic wave-absorbing pavement material, an effect is achieved in that interference caused by electromagnetic waves reflecting off the structure can be prevented.

A third aspect of the present invention is an electromagnetic wave-absorbing pavement material formed by mixing conductive fiber into a base material, wherein the conductive fiber placed in the base material resonates with electromagnetic waves to be absorbed.

With the above structure, the electromagnetic wave-absorbing pavement material functions to make the electromagnetic waves to be absorbed of the predetermined frequency band, which electromagnetic waves are used for communication, detection or measurement, resonate with the conductive fiber of predetermined length, and effectively absorb the electromagnetic waves. Therefore, when a structure is formed of the electromagnetic wave-absorbing pavement material, an effect is achieved in that the interference caused by electromagnetic waves reflecting off the structure can be effectively prevented.

A fourth aspect of the present invention is a pavement of a road using an electromagnetic wave-absorbing pavement material, the road comprising: a surface course formed of an electromagnetic wave-absorbing pavement material having an electromagnetic wave absorption function, the electromagnetic wave-absorbing pavement material being formed by mixing a conductive radio wave absorbing material, a magnetic radio wave absorbing material, or a combination thereof into a base material; and an electromagnetic wave reflecting course formed adjacent to the surface course, wherein the total amount of electromagnetic waves reflecting off a top surface of the surface course, and electromagnetic waves which enter the surface course, reflect off the electromagnetic wave reflecting course and exit from the surface course becomes minimum.

In the above structure, when the road having the above pavement is irradiated with electromagnetic waves, the electromagnetic waves reflecting off the top surface of the surface course, and the electromagnetic waves reflecting off the electromagnetic wave reflecting course and exiting from the surface course (including multiple reflected waves if any), which are among the electromagnetic waves to be absorbed by the pavement, cancel each other out, whereby the total amount of these electromagnetic waves becomes minimum. Thus, this pavement functions to reduce the amount of electromagnetic waves which are diffused after reflecting off the surface course. Further, the pavement has an effect in that the interference caused by the electromagnetic waves reflecting off the road can be prevented by the electromagnetic wave reducing function of the surface course.

A fifth aspect of the present invention is a pavement of a road using an electromagnetic wave-absorbing pavement material, wherein: the surface course is formed of the above-described electromagnetic wave-absorbing pavement material; and the electric length of the surface course is formed, by mixing in granular or powdered conductive material so as to change a dielectric constant of the surface course, such that the reflected electromagnetic waves to be absorbed, which reflect off the top surface of the surface course, and the reflecting electromagnetic waves to be absorbed, which enter the surface course and reflect off the electromagnetic wave reflecting course, have opposite phases and cancel each other out.

With the above structure, the thickness of the actual surface course and the electric length of the surface course can be made to differ from each other. As a result, the degree of freedom in road design can be improved, such as adjusting the thickness of the surface course in accordance with strength conditions of the road.

A sixth aspect of the present invention is a pavement of a road using an electromagnetic wave-absorbing pavement material, the road comprising: a surface course formed of the above-described electromagnetic wave-absorbing pavement material; and an electromagnetic wave reflecting course formed adjacent to the surface course, wherein the surface course has a thickness enabling absorption of most of electromagnetic waves of predetermined frequency therein, such that the electromagnetic waves to be absorbed which have the predetermined frequency do not exit from a top surface of the surface course after entering the surface course and reflecting off the electromagnetic wave reflecting course.

With the above structure, the electromagnetic waves to be absorbed which have entered the surface course can be prevented from reflecting off the electromagnetic reflecting course and exiting from the surface of the surface course. Thus, the above structure has an effect of further securing the electromagnetic wave absorption function of the surface course.

A seventh aspect of the present invention is a pavement of a road using an electromagnetic wave-absorbing pavement material, wherein a surface course is formed of the above-described electromagnetic wave-absorbing pavement material, and the surface course has a thickness enabling absorption therein of electromagnetic waves to be absorbed, when the electromagnetic waves to be absorbed enter the surface course through one surface thereof and are passing through the surface course.

With the above structure, the electromagnetic waves to be absorbed which have entered the surface course can be prevented from exiting from the surface of the surface course by using a simple structure having no electromagnetic wave reflecting course. Therefore, absorption of the electromagnetic waves in the surface course can further be secured. Moreover, an effect of enabling inexpensive construction of the road having this structure can be achieved.

An eighth aspect of the present invention is a pavement of a road using an electromagnetic wave-absorbing pavement material, wherein a portion of the road corresponding to a range irradiated with electromagnetic waves for communication, detection or measurement emitted from an automatic tollgate or the like has the pavement of the road using the electromagnetic wave-absorbing pavement material according to any one of the fourth to seventh aspects.

With the above structure, in automatic tollgates or the like (including automatic tollgates in parking lots or other locations), interference of electromagnetic waves reflecting off the road can be suppressed, and an operation of communication with a vehicle, detection or measurement can be well and securely carried out by using the electromagnetic waves.

Therefore, an effect is achieved in that a toll collecting operation can be stabilized and appropriately carried out in the automatic tollgates or the like.

A ninth aspect of the present invention is a pavement of a road using an electromagnetic wave-absorbing pavement material, the pavement comprising: a surface course formed of an electromagnetic wave-absorbing pavement material having an electromagnetic wave absorption function; and an electromagnetic wave reflecting course disposed under the surface course, wherein the electromagnetic wave reflecting course has: an electromagnetic wave reflection function, which is imparted to the electromagnetic wave reflecting course by forming an asphalt course, the asphalt course being formed by mixing materials such as a carbon-containing material, carbon fiber, metal fiber and a conductive material into bitumen in amounts sufficient enough to enable reflection of electromagnetic waves, impregnating conductive cloth with asphalt, or placing metal mesh, punched metal or expanded metal in the asphalt course; a function which enables close contact with courses adjacent to both surfaces of the electromagnetic wave reflecting course; and a waterproof function by which moisture is prevented from permeating the electromagnetic wave reflecting course.

With the above structure, when the road having this pavement is irradiated with the electromagnetic waves, the electromagnetic waves to be absorbed by the pavement enter the surface course formed of the electromagnetic wave-absorbing pavement material, and are absorbed before reaching the electromagnetic reflecting course. Further, the electromagnetic waves reflect off the electromagnetic wave reflecting course disposed under the surface course formed of the electromagnetic wave-absorbing pavement material, and are absorbed on their way to the top surface of the surface course formed of the electromagnetic wave-absorbing pavement material. Thus, the distance for which the electromagnetic waves proceed in the surface course formed of the electromagnetic wave-absorbing pavement material can be made twice as long to increase the absorbed amount of the electromagnetic waves. Moreover, in the structure having the electromagnetic wave reflecting course, when the road having the pavement is irradiated with electromagnetic waves, the electromagnetic waves follow a predetermined path. Namely, the electromagnetic waves enter the surface course formed of the electromagnetic wave-absorbing pavement material through the top surface thereof, reflect off the electromagnetic wave reflecting course and reach the top surface of the surface course. As a result, the electromagnetic wave absorption characteristic of the pavement becomes constant. An effect is achieved in that, when the pavement, in which the electromagnetic wave reflecting course is disposed under and adjacent to the surface course formed of the electromagnetic wave-absorbing pavement material, is applied to a road at an automatic toll gate or the like (including automatic toll gates in parking lots or other locations), an electromagnetic absorption characteristic at the time the road having the pavement is irradiated with the electromagnetic waves is calculated, whereby electromagnetic absorption performance according to design can be exhibited. Thus, the automatic tollgates and the like can be designed and constructed so as to have a predetermined electromagnetic wave absorption characteristic. If a pavement is adopted in which the electromagnetic reflecting course is not disposed under the surface course formed of the electromagnetic wave-absorbing pavement material, when a road having this pavement is irradiated with the electromagnetic waves, it is not clear how the electromagnetic waves which have passed through the surface course formed of the electromagnetic wave-absorbing pavement material reflect off the substructure disposed below the surface course formed of the electromagnetic wave-absorbing pavement material, or whether the electromagnetic waves pass therethrough. Therefore, it is very difficult to design an automatic tollgate or the like so as to have a predetermined electromagnetic wave absorption characteristic. Further, an effect is achieved in that, in the case in which the pavement is adopted in which the electromagnetic wave reflecting course is disposed under and adjacent to the surface course formed of the electromagnetic wave-absorbing pavement material, and a gas pipe or a communication cable is laid below the electromagnetic wave reflecting course, even when the pavement is irradiated with high-powered microwaves, heating of the gas cable, or communication failure such as generation of noise in signals transmitted via the communication cable can be prevented.

A tenth aspect of the present invention is a pavement using an electromagnetic wave-absorbing pavement material, which pavement comprises a surface course formed of an electromagnetic wave-absorbing pavement material having an electromagnetic wave absorption function, which electromagnetic wave-absorbing pavement material is formed by mixing a conductive radio wave absorbing material, a magnetic radio wave absorbing material, or a combination thereof into a base material, the surface course being formed so that the average dielectric constant thereof along a plane orthogonal to a direction of thickness increases from the top surface toward the bottom surface.

With the above structure, electromagnetic waves easily enter the surface of the surface course formed of the electromagnetic wave-absorbing pavement material. Thus, the electromagnetic waves directly reflecting off the top surface of the surface course formed of the electromagnetic wave-absorbing pavement material (i.e., directly reflecting waves) are reduced, such that the proportion of the electromagnetic waves entering the surface course formed of the electromagnetic wave-absorbing pavement material is increased. Since the electromagnetic waves can be effectively absorbed by the conductive material or the magnetic material in the surface course formed of the electromagnetic wave-absorbing pavement material, an effect is achieved in that the electromagnetic waves reflecting off the paved surface can be further efficiently decreased.

An eleventh aspect of the present invention is a pavement of a road using an electromagnetic wave-absorbing pavement material, which pavement comprises a surface course formed of an electromagnetic wave-absorbing pavement material having an electromagnetic wave absorption function, which electromagnetic wave-absorbing pavement material is formed by mixing a conductive radio wave absorbing material, a magnetic radio wave absorbing material, or a combination thereof into a base material, the surface course being formed so that the porosity thereof decreases gradually or continuously from the top surface toward the bottom surface of the surface course formed of the electromagnetic wave-absorbing pavement material.

With the above structure, the average dielectric constant along the surface direction of the surface course formed of the electromagnetic wave-absorbing pavement material is increased from the top surface toward the bottom surface. This structure functions to facilitate incidence of the electromagnetic waves from the top surface of the surface course formed of the electromagnetic wave-absorbing pavement material, decrease waves directly reflecting off the top surface of the surface course formed of the electromagnetic wave-absorbing pavement material, and thereby increase the proportion of the electromagnetic waves entering the surface course formed of the electromagnetic wave-absorbing pavement material. With this structure, the electromagnetic waves can be effectively absorbed by the conductive material or the magnetic material in the surface course formed of the electromagnetic wave-absorbing pavement material. As a result, an effect is achieved in that the electromagnetic waves reflecting off the paved road can be further effectively decreased.

A twelfth aspect of the present invention is a pavement of a road using an electromagnetic wave-absorbing pavement material, which pavement comprises a surface course formed of an electromagnetic wave-absorbing pavement material having an electromagnetic wave absorption function, which electromagnetic wave-absorbing pavement material is formed by mixing a conductive radio wave absorbing material, a magnetic radio wave absorbing material, or a combination thereof into a base material, the surface course being formed so that the mixing ratio of the conductive material and the magnetic material increases gradually or continuously from the top surface toward the bottom surface of an electromagnetic wave absorbing course.

With the above structure, the average dielectric constant along the surface direction of the electromagnetic wave absorbing course is increased from the top surface toward the bottom surface. This structure functions to facilitate incidence of the electromagnetic waves from the top surface of the electromagnetic wave absorbing course, decrease waves directly reflecting off the top surface of the electromagnetic wave absorbing course, and thereby increase the proportion of the electromagnetic waves entering the electromagnetic wave absorbing course. With this structure, the electromagnetic waves can be effectively absorbed by the conductive material or the magnetic material in the electromagnetic wave absorbing course. As a result, an effect is achieved in that the electromagnetic waves reflecting off the paved road can be further effectively decreased.

A thirteenth aspect of the present invention is a pavement using a pavement slab formed with an electromagnetic wave-absorbing pavement material, in which an electromagnetic wave reflection-reducing surface course formed of a material of low density and low dielectric constant such as porous concrete or a porous bituminous mixture is provided on a concrete slab.

In the above structure, the porous concrete or the porous bituminous mixture is porous and has many pores, and the electric characteristics thereof are between those of a conventional concrete or asphalt surface course and those of air. Thus, the electromagnetic waves can be prevented from reflecting off the surface of the surface course by decreasing the dielectric constant, thereby facilitating incidence of the electromagnetic waves into the surface course. Therefore, an effect of suppressing generation of unnecessary scattered electromagnetic waves is achieved. Further, when rain falls on the surface course, rainwater is quickly drained through many pores of the porous concrete or the porous bituminous mixture and thus can be inhibited from accumulating on the surface thereof. As a result, the pavement has an effect in that reflection of the electromagnetic waves off the surface of the electromagnetic wave reflection-reducing surface course due to accumulation of rainwater when it rains can be reduced.

Particularly, when the electromagnetic wave reflection-reducing surface course is formed of the porous bituminous mixture, since bitumen has a water-repellent characteristic, rainwater is repelled and does not accumulate on the surface of the electromagnetic wave reflection-reducing surface course which is covered with asphalt. Thus, the pavement has an effect of preventing formation of a film of rainwater on the surface of the electromagnetic wave reflection-reducing surface course, thereby further securely reducing the reflection of electromagnetic waves off the electromagnetic wave reflection-reducing surface course due to the rainwater that has accumulated thereon.

Accordingly, when the pavement slab for preventing electromagnetic wave interference is applied to a road or the like having a communication or control system using radio waves, effects are achieved in that communication interference caused by reflection of unnecessary radio waves can be prevented, and reliability of the system can be secured.

A fourteenth aspect of the present invention is a pavement using a pavement slab formed with an electromagnetic wave-absorbing pavement material, in which an electromagnetic wave reflection-reducing surface course is provided on a concrete slab, the electromagnetic wave reflection-reducing surface course being formed of a material formed by mixing an electromagnetic wave absorbing material with a material of low density and low dielectric constant such as porous concrete or a porous bituminous mixture, the electromagnetic wave absorbing material being formed by mixing therein a conductive radio wave absorbing material, a magnetic radio wave absorbing material, or a combination thereof, the conductive or magnetic radio wave absorbing material functioning to absorb electromagnetic waves of low intensity used for communication, detection or measurement.

In the above structure, the porous concrete or the porous bituminous mixture is porous and has many pores, and the electric characteristics thereof are between those of a conventional asphalt surface course and those of air. Thus, the electromagnetic waves can be prevented from reflecting off the surface of the surface course by decreasing the dielectric constant, thereby facilitating incidence of the electromagnetic waves into the surface course. Thus, an effect of suppressing generation of unnecessary scattered electromagnetic waves is achieved. Moreover, the electromagnetic waves entering the surface course are absorbed by the electromagnetic wave absorbing material mixed in the surface course, because of resistance loss, so-called Joule heat loss which converts electromagnetic wave energy to heat, or energy loss by dielectric current. Therefore, effects are achieved in that reflection of the electromagnetic waves off the surface course is suppressed, and the electromagnetic waves which enter the surface course, reflect off the surface of the concrete slab and then exit to the outside of the surface course can be reduced. Further, when rain falls on the surface course, rainwater is quickly drained through many pores of the porous concrete or the porous bituminous mixture. As a result, effects are achieved in that water can be inhibited from accumulating on the surface course, and reflection of the electromagnetic waves off the surface of the electromagnetic wave reflection-reducing surface course due to accumulation of rainwater when it rains can be reduced.

Accordingly, when the pavement slab for preventing electromagnetic wave interference is applied to a road or the like having a communication or control system using radio waves, effects are achieved in that communication interference caused by reflection of unnecessary radio waves can be prevented, and reliability of the system can be secured.

A fifteenth aspect of the present invention is a pavement using a pavement slab formed with an electromagnetic wave-absorbing pavement material, wherein a structure, which is formed by an electromagnetic wave reflection-reducing surface course as the uppermost course and another electromagnetic wave reflection reducing surface course disposed under the former electromagnetic wave reflection-reducing surface course, is provided on a precast concrete slab, the former electromagnetic wave reflection-reducing surface course being formed of a material of low density and low dielectric constant such as porous concrete or a porous bituminous mixture, the latter electromagnetic wave reflection-reducing surface course being formed of a material formed by mixing an electromagnetic wave absorbing material with a material of low density and low dielectric constant such as porous concrete or a porous bituminous mixture, the electromagnetic wave absorbing material being formed by mixing therein a conductive radio wave absorbing material, a magnetic radio wave absorbing material, or a combination thereof, the conductive or magnetic radio wave absorbing material functioning to absorb electromagnetic waves of low intensity used for communication, detection or measurement.

In the above structure, the porous concrete or the porous bituminous mixture forming the uppermost surface course is porous and has many pores, and the electric characteristics thereof are between those of a conventional asphalt surface course and those of air. Thus, the electromagnetic waves can be prevented from reflecting off the surface of the surface course by decreasing the dielectric constant, thereby facilitating incidence of the electromagnetic waves into the surface course. Thus, an effect of suppressing generation of unnecessary scattered electromagnetic waves is achieved. Moreover, the electromagnetic waves entering the uppermost surface course are absorbed by the electromagnetic wave absorbing material mixed in the surface course disposed under the uppermost surface course, because of resistance loss, so-called Joule heat loss which converts electromagnetic wave energy to heat, or energy loss by dielectric current. This facilitates incidence of the electromagnetic waves on the uppermost surface course and suppresses reflection of the electromagnetic waves, and the electromagnetic waves which have entered the surface course can effectively be absorbed by the underlying surface course. Therefore, effects are achieved in that reflection of the electromagnetic waves off the surface course is suppressed, and the electromagnetic waves which enter the surface course, reflect off the surface of the concrete slab and then exit to the outside of the surface course can be substantially reduced. Further, when rain falls on the surface course, rainwater is quickly drained through many pores of the porous concrete or the porous bituminous mixture and thus can be inhibited from accumulating on the surface thereof. As a result, effects are achieved in that reflection of the electromagnetic waves off the surface of the electromagnetic wave reflection-reducing surface course due to accumulation of rainwater when it rains can be reduced.

Accordingly, when the pavement slab for preventing electromagnetic wave interference is applied to a road or the like having a communication or control system using radio waves, effects are achieved in that communication interference caused by reflection of unnecessary radio waves can be prevented, and reliability of the system can be secured.

Further, in the case of this structure, a structure formed in a factory or the like by disposing an electromagnetic wave reflection-reducing surface course on the precast concrete slab can be transported to the site for construction. Thus, this structure has effects of shortening the term of construction and enabling inexpensive construction, as compared with a case in which this structure is constructed and cured on site.

Further, in this structure, after the precast concrete slab is manufactured in a factory, measurement and control of the radio wave absorption performance of the product obtained can be easily performed. Thus, an effect is achieved in that reliable quality control can be performed.

A sixteenth aspect of the present invention is the pavement using a pavement slab formed with an electromagnetic wave-absorbing pavement material according to any one of the thirteenth to fifteenth aspects, wherein the concrete slab or the precast concrete slab has at a portion thereof an electromagnetic wave-absorbing precast concrete slab, which is formed by mixing therein a conductive radio wave absorbing material, a magnetic radio wave absorbing material, or a combination thereof, the conductive or magnetic radio wave absorbing material functioning to absorb electromagnetic waves of low intensity used for communication, detection or measurement.

In addition to the operation and effects of the invention according to any one of the thirteenth to fifteenth aspects, when irradiated with the electromagnetic waves, the above structure functions to absorb the electromagnetic waves because of resistance loss, so-called Joule heat loss which converts electromagnetic wave energy to heat, or energy loss by dielectric current. Thus, an effect is achieved in that electromagnetic waves can be absorbed more effectively, in cooperation with the electromagnetic wave absorption function of the above electromagnetic wave reflection-reducing surface course.

A seventeenth aspect of the present invention is the pavement using a pavement slab formed with an electromagnetic wave-absorbing pavement material according to any one of the thirteenth to sixteenth aspects, wherein concave and convex fitting structures are provided at the border between the concrete slab or the precast concrete slab and the surface course so as to be evenly distributed at regular intervals.

In addition to the operation and effects of the invention according to any one of the thirteenth to sixteenth aspects, for example, when a vehicle passes over the precast concrete slab, the concave and convex fitting structures rigidly support shear force or the like acting between the surface course and the concrete slab due to loading (horizontal force) of the vehicle. As a result, an effect of preventing separation or sliding of courses is achieved.

An eighteenth aspect of the present invention is the pavement using a pavement slab formed with an electromagnetic wave-absorbing pavement material according to any one of the thirteenth to seventeenth aspects, wherein the concrete slab or the precast concrete slab is a precast concrete slab of reduced thickness, which is formed by using concrete of high strength, a bent bar arrangement or a fiber reinforced material in order to increase strength.

In addition to the operation and effects of the invention according to any one of the thirteenth to seventeenth aspects, the above structure has an operation such that, even when the thickness of the surface course and the precast concrete slab needs to be decreased to a predetermined thickness, the thickness thereof can be decreased while required strength is maintained. As a result, an effect is achieved in that the precast concrete slab having a decreased thickness but maintaining required strength can be favorably applied to a pavement having a limitation on the thickness.

A nineteenth aspect of the present invention is the pavement using a pavement slab formed with an electromagnetic wave-absorbing pavement material according to any one of the thirteenth to eighteenth aspects, wherein a snow-melting pipe or the like for a snow-melting system for preventing snow from accumulating or freezing on the electromagnetic wave reflection-reducing surface course is embedded.

In addition to the operation and effects of the invention according to any one of the thirteenth to eighteenth aspects, the above structure functions to melt snow by using the snow-melting pipe or the like for the snow-melting system so that snow does not accumulate or freeze on a paved surface of a surface course in a cold area when snow or the like falls thereon. As a result, an effect of preventing deterioration in the electromagnetic wave reflection-reducing performance of the electromagnetic wave reflection-reducing surface course is achieved.

BEST MODE FOR CARRYING OUT THE INVENTION

First Embodiment

Figure 1:
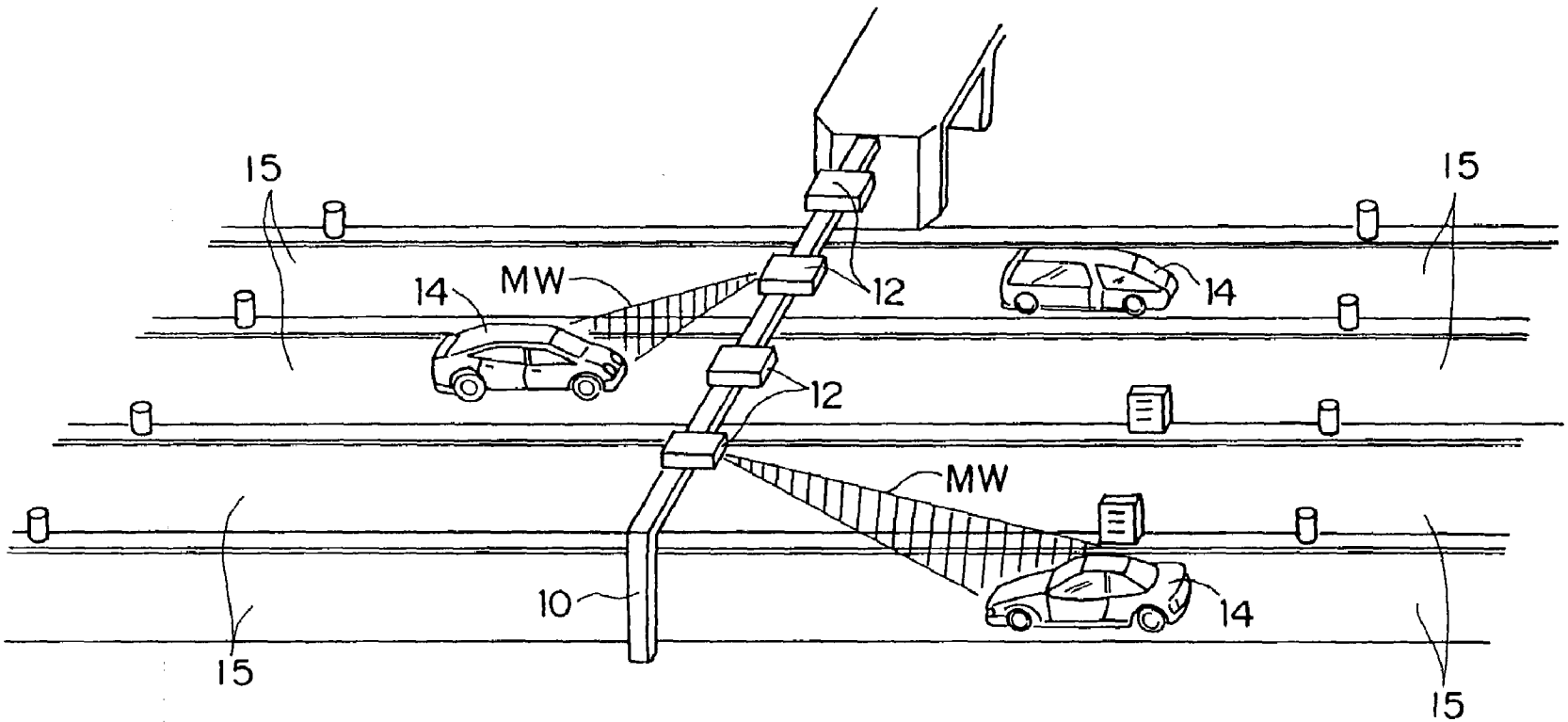
FIG. 1 is a perspective view schematically showing the structure of an automatic tollgate relating to a first embodiment of an electromagnetic wave-absorbing pavement material and a pavement using the same.

A first embodiment of an electromagnetic wave-absorbing pavement material and a road using the same in accordance with the present invention will be described with reference to FIGS. 1 to 3. FIG. 1 is a perspective view schematically showing the structure of an automatic toll collection gate for an expressway relating to the first embodiment of the present invention.

In this automatic toll collection gate, a tollgate 10 is disposed at a predetermined location of the expressway, and an automatic toll collection apparatus 12 is disposed on the tollgate 10 so as to correspond to each driving lane of the expressway.

The automatic toll collection apparatus 12 includes a vehicle detection device such as a radar or an infrared ray insulating detection means, and a radio communication device. An exemplary case in which the radar is used will be described. The automatic toll collection apparatus 12 is structured such that the radar for vehicle detection emits millimeter waves to a predetermined range at the front side of the tollgate 10 and detects that a vehicle 14 has reached a predetermined position at the front side of the tollgate 10.

Further, in the automatic toll collection apparatus 12, when the vehicle detection radar detects that the vehicle 14 has reached the predetermined position on the driving lane of a road, the radio communication device of the automatic toll collection apparatus 12 emits a communication signal MW and transmits the signal to the traveling vehicle 14.

An unillustrated automatic toll payment device is mounted in the vehicle 14 and receives the communication signal MW from the radio communication device of the automatic toll collection apparatus 12. The automatic toll collection apparatus then transmits, via radio communication, information necessary to collect a toll for the vehicle 14 (such as an entry tollgate, a type of vehicle, contract details, a paying account, and the like).

An automatic toll collection device of the automatic collection apparatus 12 which has received the information necessary to determine a toll for the vehicle 14 calculates a toll based on a traveled distance of the vehicle on the toll road and executes a toll collection process.

In the above-described automatic toll collection gate, at least a portion of the road corresponding to the predetermined range irradiated with the communication signal MW, which is formed by electromagnetic waves having a frequency band of, for example, 5.8 GHz and emitted from the radio communication device of the automatic toll collection apparatus 12 with directivity, and a portion of the road corresponding to the predetermined range irradiated with the millimeter waves emitted from the vehicle detection radar of the automatic toll collection apparatus 12, are formed by a road with a pavement having an electromagnetic wave absorption function. A pavement material, which is characterized by its absorption of electromagnetic waves of low intensity used for communication, detection or measurement, is used in the pavement.

Moreover, a portion of the road corresponding to the predetermined range can be formed by a road constructed with a precast concrete slab 15, which serves as an electromagnetic wave absorbing material having an electromagnetic wave absorption function and characterized by its absorption of the electromagnetic waves of low intensity used for communication, detection or measurement.

This structure prevents the operation of radio communication or vehicle detection from being disturbed by interference of electromagnetic waves unnecessarily reflecting off the road surface, thereby suppressing interference with the operation of toll collection or the like.

Figure 2:
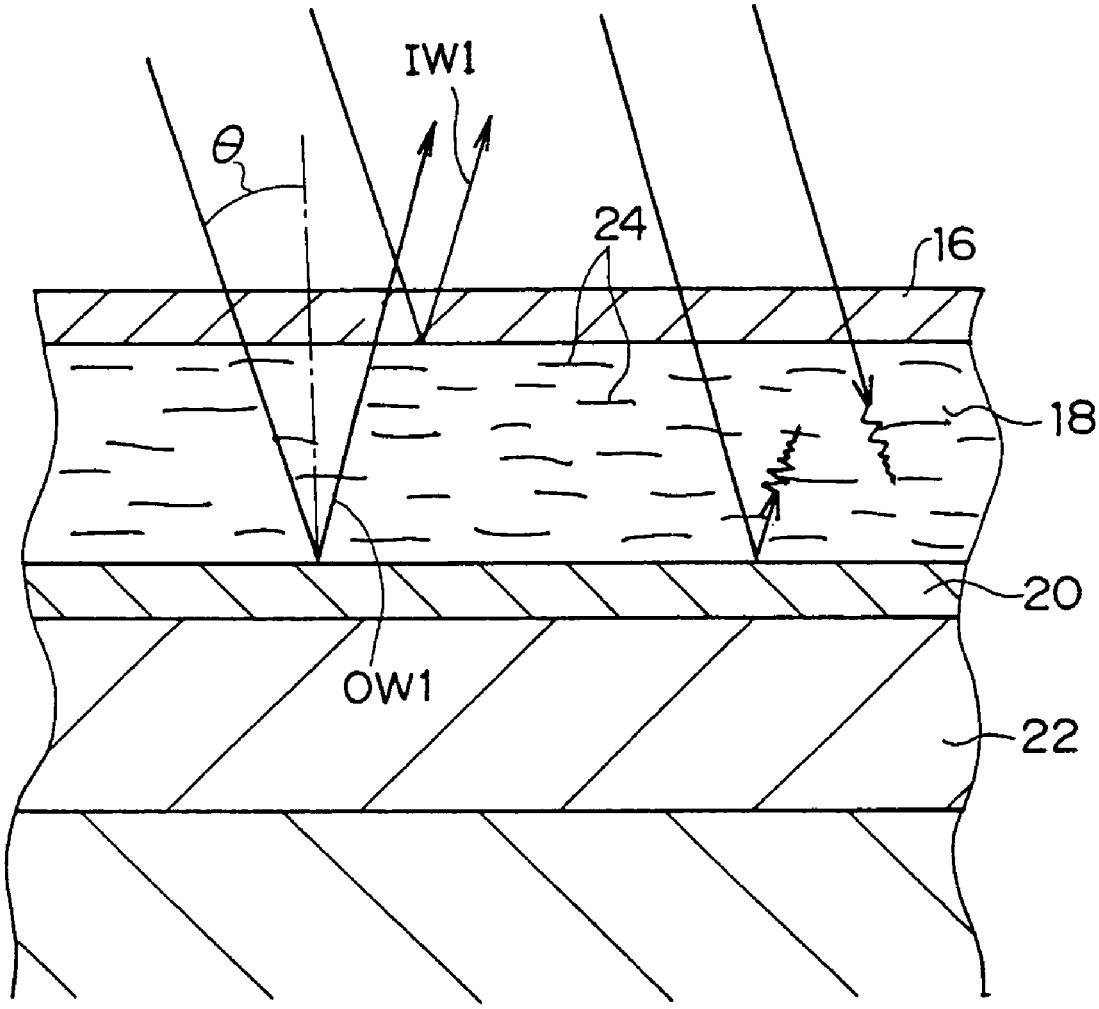
FIG. 2 is a cross section showing components of a road having an electromagnetic wave absorption function relating to the first embodiment of the electromagnetic wave-absorbing pavement material and the pavement using the same.
Figure 3:
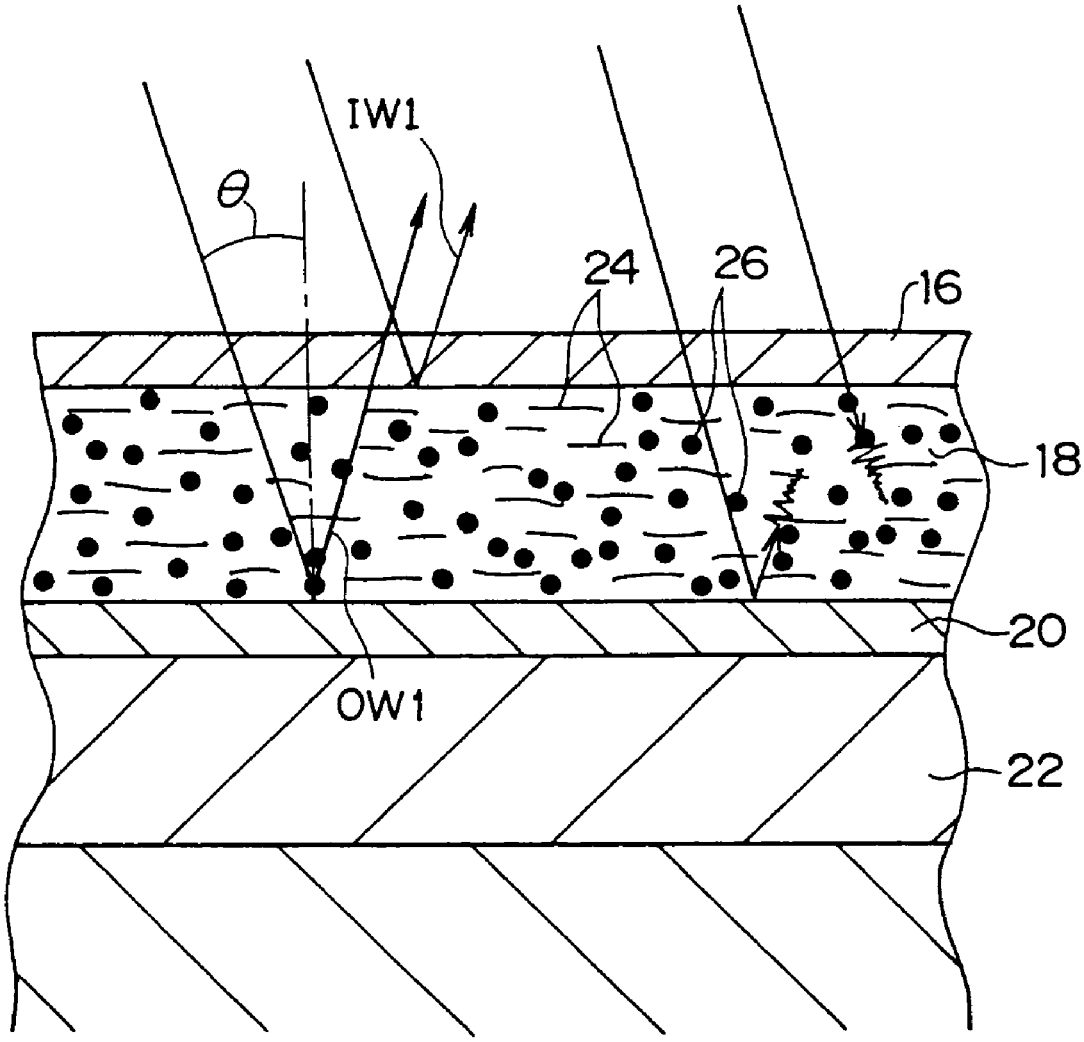
FIG. 3 is a cross section showing modified components of a road having an electromagnetic wave absorption function relating to the first embodiment of the electromagnetic wave-absorbing pavement material and the pavement using the same.

Accordingly, the road with the pavement which functions to absorb the electromagnetic waves of low intensity used for communication, detection or measurement is formed as shown in FIG. 2 or 3.

A road shown in FIG. 2 is formed by a protective course 16, which is the uppermost portion, a surface course 18 disposed under the protective course 16, an electromagnetic wave reflecting course 20 disposed under the surface course 18, and a substructure 22 disposed under the electromagnetic wave reflecting course 20.

The protective course 16 is formed on the uppermost surface of the road and protects the surface course 18 from impacts and wear caused by traffic of automobiles and the like. Deterioration in electromagnetic wave absorption performance of the surface course 18 because of a change in the surface condition or thickness of the surface course 18 caused by impacts and wear due to excessively heavy traffic of people or automobiles can be prevented by providing the protective course on the surface course 18 of the road.

In order to inhibit electromagnetic waves from reflecting off the surface of the protective course 16 and facilitate incidence of the electromagnetic waves, the protective course 16 is formed of, for example, a material, such as a conventional bituminous material or the like, having electric characteristics that are between those of air and the surface course 18, or a bituminous material having electric characteristics closer to those of air than those of the surface course 18. The protective course 16 preferably has a porous structure in order to further facilitate incidence of the electromagnetic waves.

In order to facilitate transmission of the electromagnetic waves through the surface of the protective course 16 to the surface course 18 having an electromagnetic wave absorption function, the mixture proportion for the protective course 16 is preferably designed to include aggregates for raising porosity without decreasing the strength of the protective course 16. However, transmission of the electromagnetic waves through the protective course 16 is greatly affected mainly by the dielectric constant around the surface of the protective course 16. Thus, even when the protective course 16 is formed such that the dielectric constant thereof is sufficiently small at the top surface and increases therefrom toward a bottom surface, it is possible to reduce reflection of the electromagnetic waves and efficiently transmit the electromagnetic waves to the surface course 18 having an electromagnetic wave absorption function.

The surface course 18 provided to form the road and having an electromagnetic wave absorption function is formed of a pavement material having an electromagnetic wave absorption function (energy damping). The pavement material is formed by mixing a conductive wave absorbing material, a magnetic wave absorbing material, or a combination thereof into a base material (e.g., asphalt, cement, or concrete) made of aggregates and a binder.

A carbon material or a metal material such as stainless steel, both having excellent durability, is most preferable as the conductive wave absorbing material used herein, and is used in the form of fibers, beads, or powder.

Further, as for the magnetic wave absorbing material, ferrite, or permalloy is used in the form of granulates, powder, filaments or a plate as an alternative material for the aggregate.

Furthermore, electromagnetic properties of the surface course 18 can also be adjusted by other factors such as the pore volume or the type (particularly specific gravity) of the aggregate used. In general, the dielectric constant can be decreased by increasing the pore volume.

Next, a case will be described in which the surface course 18 is formed of a pavement material which has mixed therein an electromagnetic wave absorber serving as the conductive wave absorbing material. The conductive wave absorbing material includes conductive fibers, such as carbon fibers, serving as the electromagnetic wave absorber, i.e., a substance which absorbs incident electromagnetic waves and generates loss of resistance; a substance which converts electromagnetic wave energy into heat, namely, generates so-called Joule heat loss; and a substance which generates energy loss by dielectric current.

In place of carbon fibers 24, other types such as carbon-containing fibers, needle carbon, or metal fibers may be used as the conductive fibers to be mixed into the surface course 18 as the electromagnetic wave absorber. Particularly, when carbon fibers are used, the surface course 18 can be formed so as not to be affected by weather such as rain, snow, and the like, since carbon fibers have high weatherability and high durability.

The length of the carbon fibers 24 to be mixed into the surface course 18 will be described next.

First, in order to expect generation of resistance loss when the electromagnetic waves enter the carbon fibers 24 in the surface course 18, the length (L) of the resistance loss-generating substance with respect to a wavelength λ (in a vacuum) of the electromagnetic waves to be absorbed is preferably represented by the expression $L=n\lambda/2$ (wherein n is a natural number).

Secondly, the wavelength of the electromagnetic waves becomes shorter when not in a vacuum due to a wavelength shortening effect caused by a material through which the electromagnetic waves pass, a medium, and electric characteristics of the resistance loss-generating substance itself (the carbon fibers 24 in this case), such as the dielectric constant. Considering this point, the minimum length (Lr) of the resistance loss-generating substance to be actually mixed into the surface course is calculated by a logical expression and confirmed by an experiment. It has been found out that the minimum length (Lr) of the resistance loss-generating substance to be actually mixed into the surface course is obtained by the expression $Lr \geqq \lambda/10$, which provides an effective resistance loss generation effect (electromagnetic wave absorption effect).

Next, the maximum length of the carbon fiber 24 as the resistance loss-generating substance to be mixed into the surface course 18 will be described. Factors for specifying the length (Lrmax) of the resistance loss-generating substance to be actually mixed into the surface course will be described below.

First, if the carbon fibers 24 are too long, the carbon fibers 24 get entangled, thereby making it difficult for the carbon fibers 24 to mix uniformly in the base material. Moreover, when the carbon fibers 24 are mixed and unevenly distributed into the base material, reflection of the electromagnetic waves may be substantial at a portion having a large amount of the carbon fibers 24, whereby the electromagnetic waves may reflect off the surface layer.

Secondly, the thickness of the surface course 18 is generally 30 to 50 mm in one construction process. Thus, if the carbon fiber 24 to be mixed into the surface course 18 are longer than the thickness of the surface course 18 formed in one construction process, it becomes easy for the fibers to be unevenly present in the surface course after construction.

Thirdly, the carbon fiber 24 easily breaks by bending such as folding, or by shearing. In general, the maximum dimension of the aggregate is often 15 mm or less. Even if the carbon fiber 24 of length exceeding the maximum dimension is mixed into the surface course, the carbon fiber 24 is likely to break when the base material (such as asphalt, coal tar, concrete, cement, or a resin binder) and the aggregate are kneaded.

In view of the above reasons, experimental results, and the like, it has been found that good results, namely, an electromagnetic wave absorption characteristic of about −10 to −15 dB (on site) is obtained from electromagnetic waves having a frequency band of 5.8 GHz.

The condition for the length of the carbon fiber 24, under which the carbon fiber 24 serving as the resistance loss-generating substance to be mixed into the surface course 18 can most efficiently absorb electromagnetic waves of predetermined wavelength λ to be absorbed, will be described next. The carbon fiber 24 absorbs the electromagnetic waves of the predetermined wavelength λ most efficiently when the carbon fiber 24 has a length at which the carbon fiber 24 resonates with the electromagnetic waves of the predetermined wavelength λ.

Namely, the length of the carbon fiber 24 is obtained by multiplying approximately λ/2 by a natural number, with respect to the electromagnetic waves of low intensity and the predetermined wavelength which are used for communication, detection or measurement.

The wavelength λ of the electromagnetic waves used for communication, detection or measurement shortens when the electromagnetic waves enter the protective course 16 and the surface course 18, due to the wavelength shortening effect caused by their inherent electric characteristics such as the dielectric constant and the like. Further, the wavelength of the electromagnetic waves used for communication, detection or measurement shortens when the electromagnetic waves enter the carbon fiber mixed into the surface course 18, due to the wavelength shortening effect caused by the electric characteristics of the carbon fiber such as the dielectric constant and the like.

Thus, setting the length of the carbon fiber 24 to be mixed into the surface course 18 to the length at which the carbon fiber 24 resonates with the electromagnetic waves of the predetermined wavelength λ is carried out in view of the wavelength shortening effect caused by the electric characteristics, such as the dielectric constant, inherent in the protective course 16, the surface course 18, and the carbon fiber 24.

When the length of the carbon fiber 24 is set to the length at which the carbon fiber 24 resonates, for example, a wavelength which is expected when shortened by the wavelength shortening effect of the electromagnetic waves is calculated from the electric characteristics, such as the dielectric constant, of the material forming the common surface course 18. Further, a wavelength which is expected when shortened by the wavelength shortening effect of the electromagnetic waves is calculated from the electric characteristics, such as the dielectric constant, of the carbon fiber 24. Subsequently, the wavelength of the electromagnetic waves to be shortened under actual conditions is estimated.

Next, the carbon fibers 24 having slightly different lengths around the estimated length at which the carbon fibers 24 resonate are prepared, and a sample of the surface course 18 having the carbon fibers 24 mixed therein is prepared for each length of the carbon fibers 24.

Subsequently, the carbon fibers 24 are irradiated with the electromagnetic waves of the predetermined wavelength λ used for communication, detection or measurement to determine an absorption characteristic thereof. The length of the carbon fibers 24 at which the peak effect of the absorption characteristic is obtained is set as the length at which the carbon fibers 24 resonate with the electromagnetic waves of the predetermined wavelength λ used for communication, detection or measurement.

As described above, when the carbon fibers 24 have the length at which the carbon fibers 24 resonate with the electromagnetic waves of the predetermined wavelength λ, the surface course 18 efficiently absorbs the electromagnetic waves of the predetermined wavelength λ used for communication, detection or measurement. As a result, interference caused by reflection or the like of unnecessary electromagnetic waves of the predetermined wavelength λ can be effectively prevented, and the operation of communication, detection or measurement can be securely performed.

Next, the optimum amount of the carbon fibers 24 mixed into the surface course 18 as the resistance loss-generating substance will be described.

When the amount of the carbon fibers 24 mixed into the base material increases, the amount of the electromagnetic waves reflected increases, until the surface course becomes a reflector of the electromagnetic waves. Empirically, the amount of reflection becomes large when the base material, which includes bitumen content and aggregate content in the proportion of 5 to 95 (weight ratio), is used and the carbon fibers 24 (which are 5 mm long) are mixed into the base material in an amount of 0.5% (weight ratio) of the aggregate content.

Thus, it is considered that the amount of the carbon fibers 24 to be mixed into the base material for the pavement material having the electromagnetic wave absorption function (energy damping) is preferably 0.5% (weight ratio) or less of the aggregate content.

In order to test electromagnetic wave absorption performance of a road having the electromagnetic wave absorption function, an experiment with regard to the electromagnetic wave absorption performance was carried out with a porous-paved road with the electromagnetic wave absorption function. The porous pavement was such that a bituminous mixture having 0.03% (weight ratio) of the carbon fibers 24 which were 6 mm long was laid on a precast concrete slab to form a porous structure with a thickness of 100 mm. The maximum reflection loss was about 25 dB, and therefore, satisfactory results of the electromagnetic absorption performance were obtained.

As shown in FIG. 2, the electromagnetic wave reflecting course 20 provided for the road with the pavement having the electromagnetic wave absorption function is formed with a conductive electromagnetic wave absorbing material formed of carbon fiber or metal fiber. For example, mesh (having a mesh size of preferably 1/20 or less with respect to the wavelength of the target electromagnetic waves) formed of these materials is disposed on the surface of a binder course in the substructure 22 under the surface course 18. In order to form a reflecting course, the electromagnetic reflecting course 20 may be disposed within the binder course, or the conductive electromagnetic absorbing material may be mixed into the surface or entirety of the binder course.

Moreover, in the pavement of the road using the electromagnetic wave-absorbing pavement material, the electromagnetic reflecting course 20 provided under the surface course formed of the electromagnetic wave-absorbing pavement material having the electromagnetic absorption function may be formed such that materials such as a carbon-containing material, carbon fiber, metal fiber, ferrite, and a conductive material are mixed together to form an asphalt/bitumen course. The amounts of the materials are made large enough to reflect the electromagnetic waves.

Further, the electromagnetic wave reflecting course 20 may be formed in layers by impregnating conductive cloth with asphalt. Furthermore, the electromagnetic reflecting course 20 may be formed in layers of asphalt/bitumen with metal mesh, punched metal or expanded metal being interposed therebetween.

With the above structure, the electromagnetic reflecting course 20 can have the electromagnetic reflection function.

Moreover, in order to prevent the electromagnetic wave reflecting course 20 from sliding between the surface course 18 and the substructure 22, which are the courses adjacent to the electromagnetic wave reflecting course 20 at both surfaces thereof, the electromagnetic wave reflecting course 20 is formed so as to closely contact the surface course 18 and the substructure 22 sufficiently.

Further, a waterproof function is imparted to the electromagnetic wave reflecting course 20 so that moisture or the like is prevented from passing through the electromagnetic wave reflecting course 20.

When the above-described electromagnetic wave reflecting course 20 is provided, the electromagnetic waves, when the road having the above pavement is irradiated therewith, enter the surface course 18 of the electromagnetic wave-absorbing pavement material through the surface thereof. The electromagnetic waves are subjected to multiple reflection between the surface course 18 and the electromagnetic wave reflecting course 20, and the electromagnetic wave reflecting course 20 functions as a single layer type electromagnetic wave absorber. (Alternatively, the electromagnetic wave reflecting course 20 may be formed as an electromagnetic wave absorber of multi-layer type). As a result, the electromagnetic wave absorption characteristic of the pavement becomes constant.

When the pavement, in which the electromagnetic wave reflecting course 20 is disposed under and adjacent to the surface course 18 formed of the electromagnetic wave-absorbing pavement material, is applied to a road at an automatic tollgate or the like (including automatic tollgates in parking lots or other locations), an electromagnetic absorption characteristic at the time the road having the pavement is irradiated with the electromagnetic waves is calculated, whereby electromagnetic absorption performance according to design can be exhibited.

Thus, the automatic tollgates and other facilities can be designed and constructed so as to have a predetermined electromagnetic wave absorption characteristic.

If a pavement is adopted in which the electromagnetic reflecting course 20 is not disposed under the surface course 18 formed of the electromagnetic wave-absorbing pavement material, when a road having this pavement is irradiated with the electromagnetic waves, it is not clear how the electromagnetic waves which have passed through the surface course 18 formed of the electromagnetic wave-absorbing pavement material reflect off the substructure disposed below the surface course 18 formed of the electromagnetic wave-absorbing pavement material, or whether the electromagnetic waves pass therethrough. Therefore, it becomes very difficult to design an automatic tollgate or other facilities so as to have a predetermined electromagnetic wave absorption characteristic.

Further, in the case in which the pavement is adopted in which the electromagnetic wave reflecting course is disposed under and adjacent to the surface course 18 formed of the electromagnetic wave-absorbing pavement material, and a gas pipe or a communication cable is laid below the electromagnetic wave reflecting course, even when the pavement is irradiated with high-powered microwaves, heating of the gas cable, or communication failure such as noise in signals transmitted via the communication cable can be prevented.

Furthermore, the substructure 22 has a conventional composition having sand, gravel or concrete.

Next, the electromagnetic wave absorption function of the road formed by the generally used single layer type wave absorber, which is described above and shown in FIG. 2, will be described.

The road shown in FIG. 2 is formed so as to reduce reflected waves by providing the electromagnetic wave reflecting course 20 under the bottom surface of the surface course 18 and controlling the amplitudes and phases of reflected electromagnetic waves OW1 from the electromagnetic wave reflecting course 20 and reflected electromagnetic waves IW1 from the top surface of the surface course 18.

Namely, the reflected electromagnetic waves IW1 reflecting off the top surface of the surface course 18, and the reflected electromagnetic waves OW1 (including multiple reflection waves) which have entered the surface course 18, reflected off the electromagnetic wave reflecting course 20 and transmitted through the surface course 18 have opposite phases such that the reflection coefficient of the surface course 18 becomes close to zero.

In order for the reflected electromagnetic waves IW1 and the reflected electromagnetic waves OW1 to have the opposite phases, it suffices if the thickness D of the surface course 18 is set by the expression $D=\lambda(n+1)/4 \cos \theta$ (wherein $\lambda$ is a wavelength of the electromagnetic waves to be absorbed, n is a natural number, and $\theta$ is an incidence angle of the electromagnetic waves).

With this structure, the phase of the reflected electromagnetic waves OW1 which have entered the surface course 18, reflected off the electromagnetic wave reflecting course 20 and transmitted through the surface course 18 becomes opposite that of the reflected electromagnetic waves IW1 reflecting off the top surface of the surface course 18. Consequently, the reflected electromagnetic waves IW1 and the reflected electromagnetic waves OW1 cancel each other out so as to disappear or damp.

In this way, reflection of the electromagnetic waves off the road having the surface course 18 provided therein can be reduced.

Further, in order to make the phase of the reflected electromagnetic waves OW1 opposite in the surface course 18, in place of setting the thickness D of the surface course 18 to $\lambda(n+1)/4 \cos \theta$, the dielectric constant of the surface course 18 may be changed so that the so-called electric length of the surface course 18 is changed and adjusted to $\lambda(n+1)/4 \cos \theta$.

When the dielectric constant of the surface course 18 is changed so that the so-called electric length of the surface course 18 is changed and adjusted to $\lambda(n+1)/4 \cos \theta$, in addition to the carbon fibers 24, an appropriate amount of carbon granules 26 (or carbon powder) are mixed into the pavement material for the surface course 18, as shown in FIG. 3.

In this way, the dielectric constant of the pavement material forming the surface course 18 is changed and adjusted, and the electric length of the surface course 18 is changed and adjusted to $\lambda(n+1)/4 \cos \theta$, such that the phase of the reflected electromagnetic waves OW1 reflecting off the electromagnetic wave reflecting course 20 becomes opposite.

With this structure, the thickness of the actual surface course 18 and the electric length of the surface course 18 can be made to differ from each other. As a result, the degree of freedom in road design can be improved, such as adjusting the thickness of the surface course 18 in accordance with strength conditions of the road.

Further, by forming the road as shown in FIG. 3, both the carbon fibers 24 and the carbon granules 26 in the pavement material of the surface course 18 mutually generate an electromagnetic induction phenomenon, whereby energy loss caused by induced current can be increased, and more energy of the electromagnetic waves to be absorbed can be damped.

Further, the thickness of the surface course 18 in the road may be increased such that the electromagnetic waves which have entered the surface course 18 damp and disappear while reflecting off the electromagnetic wave reflecting course 20 and passing through the surface course 18, and thus do not exit from the top surface of the surface course 18.

Alternatively, the thickness of the surface course 18 may be increased by a needed amount such that the electromagnetic waves which have entered the surface course 18 are absorbed and disappear on their way to the bottom surface of the surface course 18.

Next, operation and effects of the case in which at least a predetermined range of the road at the automatic tollgate shown in FIG. 1 is formed by a portion of the road having the pavement formed by using the pavement material having the above-described electromagnetic wave absorption function will be described. The pavement material used herein is formed so as to absorb even millimeter waves of a radar. (Namely, the pavement material includes the carbon fibers 24 having such a length as to absorb the millimeter waves of the radar, and the carbon fibers 24 having such a length as to absorb electromagnetic waves having a frequency band of, for example, 5.8 GHz, which electromagnetic waves are emitted from the radio communication device of the automatic toll collection apparatus 12.)

In this automatic tollgate, millimeter waves are emitted from a vehicle detection radar of the automatic toll collection apparatus 12 located at the automatic tollgate to detect the vehicle 14 traveling on the road toward the automatic toll collection apparatus 12.

At this time, the millimeter waves emitted from the radar are absorbed by the road having the electromagnetic absorption function. Thus, the vehicle 14 can appropriately be detected without malfunction of the radar due to interference of unnecessary electromagnetic waves which have reflected off the road.

After the radar of the automatic toll collection apparatus 12 detects the vehicle 14 at a predetermined position as described above, the radio communication device of the automatic toll collection apparatus 12 carries out radio communication with the automatic toll payment device mounted in the vehicle 14 by using the communication signal MW, which is formed by electromagnetic waves having a frequency band of, for example, 5.8 GHz, thereby executing the toll collection process.

At this time, the electromagnetic waves having a frequency band of 5.8 GHz emitted from the radio communication device of the automatic toll collection apparatus 12 are absorbed when impinging upon the road having the electromagnetic absorption function.

Accordingly, malfunction such as simultaneous execution of the toll collection process for the vehicle 14 detected at the predetermined position and a toll collection process for a subsequent vehicle due to electromagnetic wave interference, in which the electromagnetic waves having a frequency band of 5.8 GHz emitted from the radio communication device reflect off the road and are received by the subsequent vehicle traveling immediately after the vehicle 14 detected at the predetermined position, can be effectively prevented.

Further, although not illustrated, when the pavement material having the electromagnetic wave absorption function relating to the first embodiment is used in the AHS, a portion of the road within a range necessary to remove electromagnetic wave interference around the lane markers provided at the respective predetermined positions of the road along the driving lanes for automobiles on the road is formed of the pavement material having the electromagnetic wave absorption function. Namely, the road is formed such that the pavement material having the electromagnetic wave absorption function is disposed in the shape of a circle of predetermined radius at a portion surrounding the lane marker. Alternatively, the road is formed such that the pavement material having the electromagnetic wave absorption function is disposed in the shape of an ellipse or a rectangle along a longitudinal direction of the road.

With this structure, the detection device such as the radar of a cruise-assistance apparatus mounted in an automobile traveling on the road can appropriately detect the position of the lane marker and an appropriate traveling route without being subjected to electromagnetic wave interference. Moreover, various types of communication can be appropriately performed between the communication equipment at the lane marker disposed on the road and the vehicle without being subjected to electromagnetic wave interference.

The structure in which the electromagnetic wave-absorbing pavement material is used for pavement of a road has been described in the first embodiment. However, this electromagnetic wave-absorbing pavement material can be used as a structural material for forming various types of pavements. Thus, in this description, the "pavement material" is defined as having a broad meaning, including a material for forming a pavement for a floor of a parking lot, a material for forming a pavement for a floor of a building, a material for forming a pavement for a runway, a material for forming a pavement for a floor of an airplane hangar, or a material which can form a pavement for a tunnel or other general structures irradiated with the electromagnetic waves. Further, a similar effect can be expected when the automatic tollgate to which the present invention is applied is an automatic tollgate in a parking lot or other location.

Only the case in which the electromagnetic wave-absorbing pavement material and the road using the same according to the first embodiment is applied to the automatic tollgate has been described above. However, the structure of the road having the pavement material and the pavement using the same can be applied to any facility in order to prevent electromagnetic wave interference, so long as the electromagnetic waves are used on a paved surface.

For example, the structure can also be applied to pavements for roads using various cruise-assist highway systems, traffic information providing devices on roads, and navigation systems; structures for forming soundproof walls and protective surfaces with concrete being used as a binder, wall surfaces of buildings, and wall surfaces of tunnels; and the like. The structure can be applied not only to roads but also to cruise-assist devices for forming pavements of automatic tollgates in parking lots and roads inside buildings, so that electromagnetic wave interference is prevented.

Second Embodiment

A pavement relating to a second embodiment of the present invention will be described next with reference to FIG. 4.

In the pavement relating to the present second embodiment, a portion of a road which extends to a predetermined range of an automatic tollgate irradiated with the communication signal MW, which is formed by the electromagnetic waves having a frequency band of, for example, 5.8 GHz and emitted with directivity from at least the radio communication device of the automatic toll collection apparatus 12, and to a predetermined range irradiated with millimeter waves emitted from the vehicle detection radar of the automatic toll collection apparatus 12, is formed by a road having the electromagnetic wave absorption function. A pavement material which functions to absorb electromagnetic waves of low intensity used for communication, detection or measurement is used in the road having the electromagnetic wave absorption function.

This pavement is a three-course structure formed by the electromagnetic wave reflecting course 20, a surface course 28 having an electromagnetic wave absorption function, and the protective course 16, and these courses are disposed on the substructure 22 in this order. Further, the surface course 28 having the electromagnetic wave absorption function has a double-course structure formed by a precast course 30 and a packed bed 32 having different functions along directions of thickness and surfaces thereof.

The precast course 30 of the surface course 18 having the electromagnetic wave absorption function is formed by a plurality of substantially pyramid-shaped or conical blocks 34. Namely, each of these blocks 34 has a trapezoidal shape with a cross-section thereof narrowing upwards along the thickness direction, as shown in FIG. 4. The block 34 is basically formed of the same material as the surface course 18 having the electromagnetic wave absorption function in the pavement according to the first embodiment, namely, the asphalt/bituminous mixture having at least one of the conductive material and the magnetic material mixed therein.

However, the conductive material or the magnetic material mixed into the bituminous mixture is mixed such that the mixing ratio of the entire surface course 28 having the electromagnetic wave absorption function is substantially equal to that of the surface course 18 having the electromagnetic wave absorption function (shown in FIG. 1). Thus, each of the blocks 34 has a mixing ratio of the conductive material or the magnetic material higher than that of the surface course 18 having the electromagnetic wave absorption function.

The blocks 34 are molded into the illustrated shape by molding equipment (not shown) in a factory or self-propelled molding equipment (not shown) movable to a construction site, for example, and are laid on the substructure 22. In this way, the precast course 30 of the surface course 28 having the electromagnetic wave absorption function is formed in the pavement.

The bituminous mixture is filled, without a gap, between outer surfaces of the blocks 34 laid on the substructure 22. The packed bed 32 of the surface course 28 having the electromagnetic wave absorption function is formed by the bituminous mixture.

Since at least one of the conductive material and the magnetic material is mixed into the block 34, and none of the conductive material and the magnetic material is mixed into the packed bed 32, the dielectric constant of the packed bed 32 is sufficiently smaller than the dielectric constant of the precast course 30. As a result, an electromagnetic characteristic, by which the average dielectric constant of the surface course 28 along a plane orthogonal to the thickness direction continuously increases from a top surface 28A toward a bottom surface 28B, is imparted to the entire surface course 28 having the electromagnetic wave absorption function.

The increasing amount (increasing rate) of the dielectric constant of the surface course 18 having the electromagnetic wave absorption function per unit length along the thickness direction thereof can be adjusted by changing the increasing ratio of the cross-sectional area of the block 34 extending from the top surface 28A to the bottom surface 28B. Further, the block 34 does not necessarily need to have the shape of a truncated cone or a truncated pyramid. For example, a plurality of cylindrical or prismatic blocks having different cross-sectional areas along the surface direction may be stacked one over another so that the average dielectric constant along the plane orthogonal to the thickness direction increases from the top surface 28A toward the bottom surface 28B. In this case, however, the average dielectric constant of the surface course 28 having the electromagnetic wave absorption function gradually increases from the top surface 28A toward the bottom surface 28B.

Figure 4:
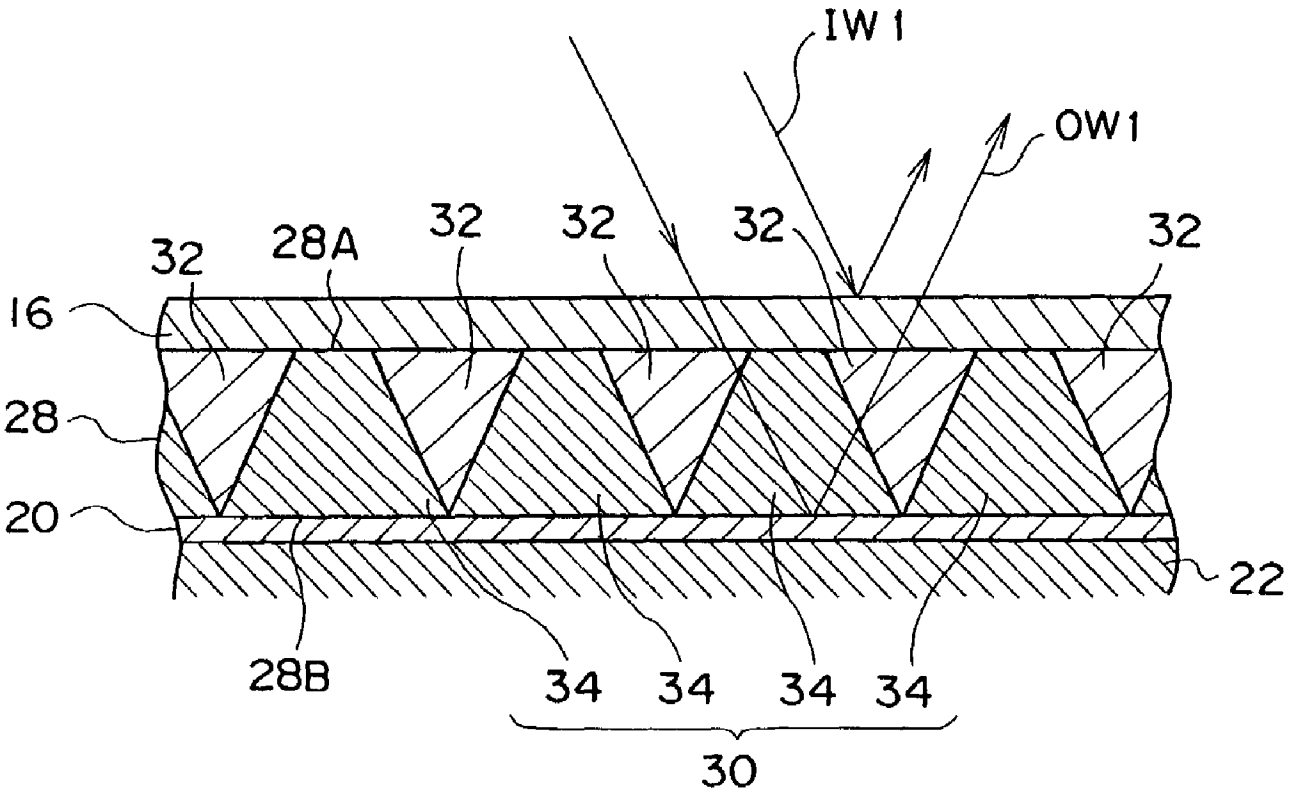
FIG. 4 is a cross section of a pavement relating to a second embodiment of the electromagnetic wave-absorbing pavement material and the pavement using the same of the present invention.

Although the packed bed 32 and the protective course 16 are illustrated in FIG. 4 as separate courses, the packed bed 32 and the protective course 16 may be integrally formed by the same material. Further, the length and the mixing ratio of the carbon fibers 24 serving as the conductive material to be mixed into the surface course 28 (precast course 30) having the electromagnetic wave absorption function are appropriately set in the same way as in the above-described first embodiment.

As described above, according to the pavement relating to the present second embodiment, the surface course 28 having the electromagnetic wave absorption function is formed by mixing at least one of the conductive material and the magnetic material into the precast course 30, which forms the surface course 28 having the electromagnetic wave absorption function together with the packed bed 32. Thus, similarly to the pavement relating to the first embodiment, the electromagnetic waves which have entered the surface course 28 having the electromagnetic wave absorption function can be well absorbed, whereby the electromagnetic waves reflecting off the road can be effectively reduced.

Moreover, in the pavement relating to the present second embodiment, since the average dielectric constant along the plane of the surface course 28 having the electromagnetic wave absorption function, which plane is orthogonal to the thickness direction, continuously increases from the top surface 28A toward the bottom surface 28B, the electromagnetic waves can be effectively suppressed from directly reflecting off the top surface 28A of the surface course 28 having the electromagnetic wave absorption function. As a result, directly reflected waves can be reduced, and electromagnetic waves entering the surface course 28 having the electromagnetic wave absorption function can be increased.

Consequently, incident electromagnetic waves can be effectively absorbed by the conductive material or the magnetic material within the surface course 28 having the electromagnetic wave absorption function. Accordingly, the electromagnetic waves reflecting off the paved surface can be more effectively reduced, as compared with the pavement of the first embodiment. Therefore, various types of electromagnetic wave interference caused by the electromagnetic waves reflecting off the paved surface can be more effectively prevented by applying the pavement relating to the present second embodiment to a communication area of the automatic tollgate and driving lanes within a detection area.

In the pavement relating to the second embodiment, the cross-section area of the blocks 34 forming the precast course 30 is changed along the thickness direction such that the dielectric constant of the surface course 28 having the electromagnetic wave absorption function is continuously changed. However, as an alternative to this structure, for example, the average dielectric constant of the surface course 28 having the electromagnetic wave absorption function along the surface direction can be increased continuously or gradually from the top surface 28A toward the bottom surface 28B by gradually or continuously decreasing the porosity of the surface course 28 having the electromagnetic wave absorption function from the top surface 28A toward the bottom surface 28B.

In this case, the porosity of the surface course 28 having the electromagnetic wave absorption function can be decreased gradually or continuously from the top surface 28A toward the bottom surface 28B by continuously or gradually changing the proportion of the aggregate to be mixed into the bituminous mixture which forms the surface course 28 having the electromagnetic wave absorption function.

Further, when the porosity of the surface course 28 having the electromagnetic wave absorption function is gradually changed, the surface course 28 having the electromagnetic wave absorption function may be gradually formed by various types of bituminous mixtures having different proportions of the aggregate.

Furthermore, the average dielectric constant of the surface course 28 having the electromagnetic wave absorption function along the surface direction can also be increased continuously or gradually from the top surface 28A toward the bottom surface 28B by gradually or continuously increasing from the top surface 28A toward the bottom surface 28B the mixing ratio of the conductive material or the magnetic material mixed into the surface course 28 having the electromagnetic wave absorption function.

The structures, operation and effects other than those described above in the present second embodiment are similar to those of the foregoing first embodiment. Thus, members which are similar to the those of the pavement relating to the first embodiment described above and shown in FIGS. 1 to 3 are designated by the same reference numerals, and detailed description thereof is omitted.

Third Embodiment

A pavement relating to a third embodiment of the present invention will be described next with reference to FIGS. 5 to 10.

In the pavement relating to the present third embodiment, a portion of the road which extends to the predetermined range of the automatic tollgate irradiated with the communication signal MW, which is formed by the electromagnetic waves having a frequency band of, for example, 5.8 GHz and emitted with directivity from at least the radio communication device of the automatic toll collection apparatus 12, and to the predetermined range irradiated with the millimeter waves emitted from the vehicle detection radar of the automatic toll collection apparatus 12, is formed by a road having the electromagnetic wave absorption function, which road is constructed with a precast concrete slab which functions to absorb the electromagnetic waves of low intensity used for communication, detection or measurement.

The precast concrete slab 15, which forms the road having the pavement which functions to absorb the electromagnetic waves of low intensity used for communication, detection or measurement, is formed so as to have structures shown in FIGS. 5 to 10.

Figure 5:
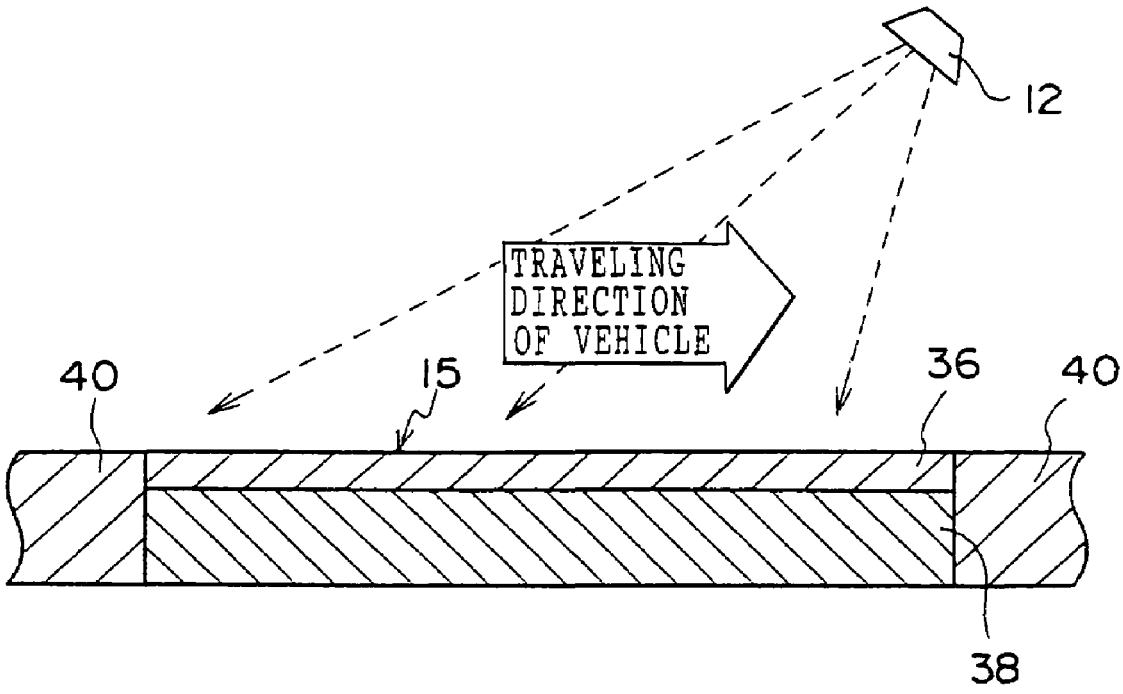
FIG. 5 is an enlarged cross section of a main portion of a road having an electromagnetic wave reflection-reducing surface course relating to a third embodiment of the electromagnetic wave-absorbing pavement material and the pavement using the same of the present invention.

A road shown in FIG. 5 is formed by disposing an electromagnetic wave reflection-reducing surface course 36 at the uppermost portion and disposing a precast concrete slab 38 thereunder. Portions of the road other than the portion where the electromagnetic wave reflection-reducing surface course 36 and the precast concrete slab 38 are disposed have a general structure of a paved road 40.

The electromagnetic wave reflection-reducing surface course 36 is formed of a material of low density and low dielectric constant, such as porous concrete or a porous bituminous mixture.

The porous concrete or the porous bituminous mixture forming the electromagnetic wave reflection-reducing surface course 36 has a porous structure, such as a porous structure in which an outflow of soil particles is prevented but only water can flow freely.

Namely, the electromagnetic wave reflection-reducing surface course 36 formed of the porous concrete or the porous asphalt/bituminous mixture has electric characteristics which are between those of a surface course formed of conventional concrete or asphalt and those of air, or are closer to those of air than those of the surface course formed of conventional concrete or asphalt. For this reason, the electromagnetic wave reflection-reducing surface course 36 has a dielectric constant smaller than that of ordinary dense and solid concrete. Thus, reflection of the electromagnetic waves off the surface of the surface course 36 can be suppressed, thereby facilitating incidence of the electromagnetic waves.

In addition, when rain falls on the porous concrete or the porous bituminous mixture forming the electromagnetic wave reflection-reducing surface course 36, rainwater is quickly drained through many pores of the porous concrete or the porous bituminous mixture. Therefore, water can be inhibited from accumulating on the surface of the porous concrete or the porous bituminous mixture, and reflection of the electromagnetic waves off the surface of the electromagnetic wave reflection-reducing surface course 36 when it rains can be reduced.

In order to reduce reflection of radio waves off the porous concrete or the porous bituminous mixture used in the electromagnetic wave reflection-reducing surface course 36, it is preferable to increase the porosity $n_a$ thereof (the ratio of the volume $V_a$ of air or other gas in the porous concrete or the porous bituminous mixture to the total volume V of the porous concrete or the porous bituminous mixture, i.e., $n_a=V_a/V\times100$ [%]) because the larger the porosity $n_a$, the smaller the dielectric constant.

Further, the electromagnetic wave reflection-reducing surface course 36 needs to have mechanical characteristics required for a pavement.

In view of the above, the porous concrete or the porous bituminous mixture used in the electromagnetic wave reflection-reducing surface course 36 has a porosity $n_a$ of preferably 40% or less.

Moreover, when reflection of the electromagnetic waves off the surface of the electromagnetic wave reflection-reducing surface course 36 needs to be further suppressed, the electromagnetic wave reflection-reducing surface course 36 is formed so that the dielectric constant thereof is decreased from the base course side toward the surface thereof.

In order to change the dielectric constant of the electromagnetic wave reflection-reducing surface course 36, the electromagnetic wave reflection-reducing surface course 36 is formed so that the density (such as the porosity) is changed within the course. Alternatively, the electromagnetic wave reflection-reducing surface course 36 may be formed by a plurality of courses having different densities, which courses are superposed such that the density gradually decreases from the base course side toward the surface of the electromagnetic wave reflection-reducing surface course 36.

As an alternative structure of the electromagnetic wave reflection-reducing surface course 36, a material having the electromagnetic wave absorption function is added to the porous concrete or the porous bituminous mixture. Namely, a part or all of the electromagnetic wave reflection-reducing surface course 36 is formed of a material, which is formed by mixing an appropriate amount of the conductive material such as carbon fiber or the magnetic material such as ferrite powder into the porous concrete or the porous bituminous mixture.

The electromagnetic wave reflection-reducing surface course 36 having the electromagnetic wave absorption function is formed of an electromagnetic wave absorbing material having the electromagnetic absorption function (energy damping), which material is formed by mixing a conductive radio wave absorbing material, a magnetic radio wave absorbing material, or a combination thereof into a material such as the porous concrete or the porous bituminous mixture.

A highly durable carbon material or a metal material such as stainless steel is preferable as the conductive radio wave absorbing material used herein, which is a dielectric material. These materials are used in the form of fibers, beads, or powder.

Further, a material such as ferrite or permalloy is used in the form of granulates, powder, filaments or a plate as the magnetic material used herein such as the magnetic radio wave absorbing material.

Next, a case will be described in which the electromagnetic wave reflection-reducing surface course 36 is formed of an electromagnetic wave absorbing material having added thereto an electromagnetic wave absorber (including conductive fibers, such as carbon fibers, serving as the electromagnetic wave absorber, i.e., a substance which absorbs incident electromagnetic waves and generates loss of resistance; a substance which converts electromagnetic wave energy into heat, namely, generates so-called Joule heat loss; and a substance which generates energy loss by dielectric current) that serves as the conductive radio wave absorbing material.

In place of carbon fibers serving as the conductive fibers, carbon-containing fibers, needle carbon, or metal fibers such as a stainless material may be used as the electromagnetic wave absorber which is added to the electromagnetic wave absorbing material for forming the electromagnetic wave reflection-reducing surface course 36. Particularly, when carbon fibers are used, the electromagnetic wave reflection-reducing surface course 36 can be formed so as not to be affected by weather such as rain, snow, and the like, since the carbon fibers have high weatherability and high durability.

The length of the carbon fiber to be added to the electromagnetic wave reflection-reducing surface course 36 as the electromagnetic wave absorber will be described next.

In order to expect generation of resistance loss when the electromagnetic waves enter the carbon fiber, the length (L) of the carbon fiber with respect to the wavelength $\lambda$ (in a vacuum) of the electromagnetic waves to be absorbed is preferably represented by the expression $L=2\lambda/n$ (wherein n is an integer).

In practice, the length of the carbon fiber is 1/10 or more of the wavelength ($\lambda$) of the electromagnetic waves to be absorbed, considering a wavelength shortening effect caused by the electric characteristics, such as the dielectric constant and the like, of the radio wave absorbing course. Moreover, if the fibers which are longer than the thickness of the surface course formed in one construction process, it becomes easy for the fibers to be unevenly present in the surface course after construction. Thus, the maximum length of the carbon fiber is equal to or less than the thickness of the surface course formed in one construction process (generally about 30 to 50 mm in the case of asphalt pavement).

Further, mesh or a sheet of the carbon fiber, metallic mesh, or metallic foil may be provided as a radio wave reflecting course on a rear surface of the radio wave absorbing course, such that radio waves reflect off the radio wave reflecting course and pass through the radio wave absorbing course in a reciprocating manner along a long path, whereby more of the radio waves are absorbed in the radio wave absorbing course. Alternatively, reinforcing steel inside the precast concrete slab may also be used as a reflecting course.

In the above described way, the electromagnetic wave absorption function is imparted to the electromagnetic wave reflection-reducing surface course 36, and reflection of unnecessary electromagnetic waves off the electromagnetic wave reflection-reducing surface course 36 is reduced.

Further, when reflection of the electromagnetic waves off the surface of the electromagnetic wave reflection-reducing surface course 36 needs to be further suppressed, the electromagnetic wave reflection-reducing surface course 36 is structured such that.the amount of the conductive material such as the carbon fiber or the magnetic material such as the ferrite powder mixed into the surface course 36 gradually decreases within the course from the base course side toward the surface thereof.

Furthermore, in order to suppress the electromagnetic waves from reflecting off the surface of the electromagnetic wave reflection-reducing surface course 36, the electromagnetic wave reflection-reducing surface course 36 may be formed by a plurality of courses having different amounts of the conductive material such as the carbon fiber or the magnetic material such as the ferrite powder mixed into the surface course 36. These courses are superposed such that the amounts of the conductive material such as the carbon fiber or the magnetic material such as the ferrite powder mixed into these courses gradually decrease from the base course side of the surface course 36 toward the surface thereof.

Figure 18:
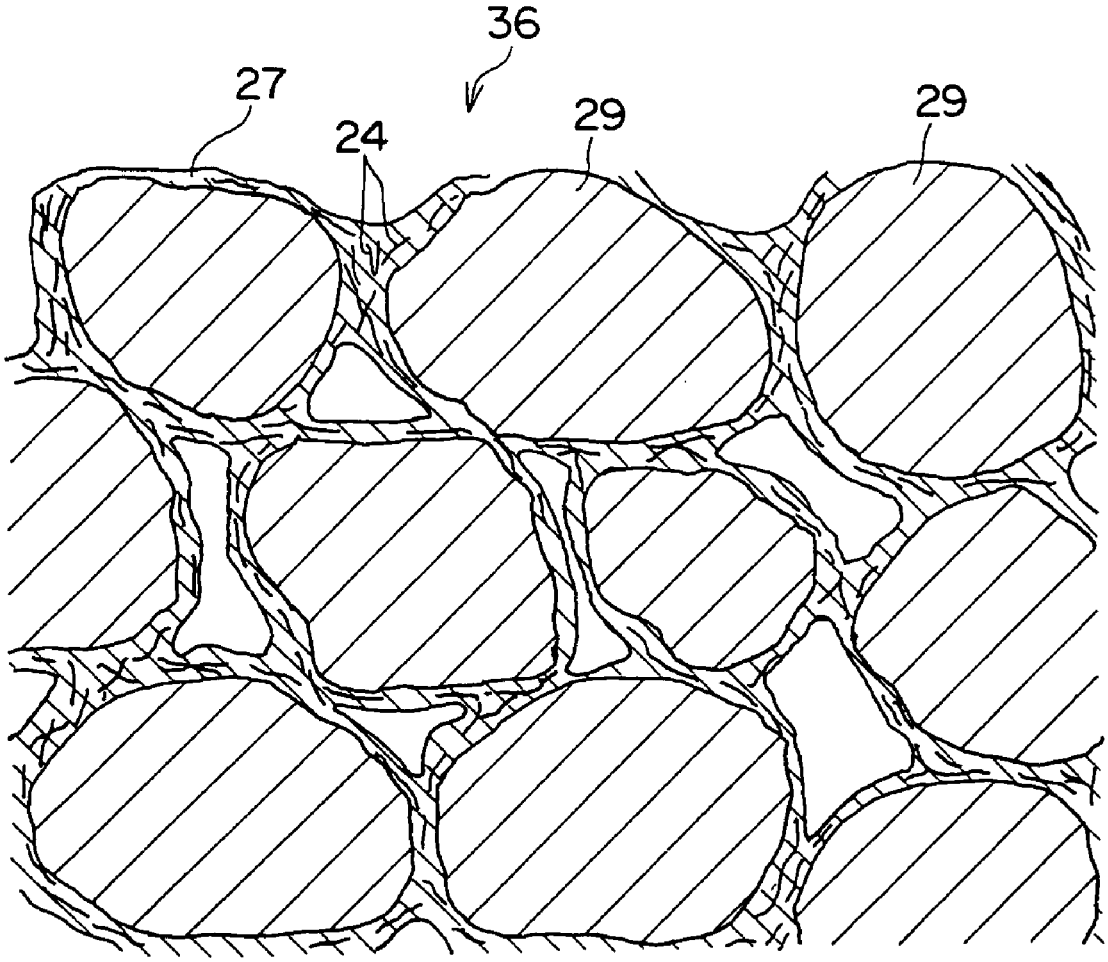
FIG. 18 is an enlarged cross section showing a main portion of a porous structure of the electromagnetic wave reflection-reducing surface course of the road relating to the third embodiment of the electromagnetic wave-absorbing pavement material and the pavement using the same of the present invention.

Moreover, as shown in FIG. 18, the electromagnetic wave reflection-reducing surface course 36 can be formed as a surface course of a so-called porous asphalt road generally constructed, by an electromagnetic wave absorbing material having the electromagnetic wave absorption function (energy damping). The electromagnetic wave absorbing material is formed by mixing the conductive radio wave absorbing material, the magnetic radio wave absorbing material, or a combination thereof into a material such as the bituminous mixture or the like.

For example, the electromagnetic wave reflection-reducing surface course 36 serving as the surface course of the porous asphalt road having the electromagnetic absorption function (energy damping) can be formed by placing the material such as the bituminous mixture, and the conductive radio wave absorbing material, the magnetic radio wave absorbing material, or a combination thereof in a mixer, mixing these materials well, and then applying the mixture on the asphalt road having a general porous structure.

As shown in FIG. 18, the surface course of the porous asphalt road formed as described above, which surface course has low density, low dielectric constant and the electromagnetic wave absorption function (energy damping), presents a pavement of the asphalt road having a general porous structure in which an asphalt course 27 covers and surrounds pebbles 29 serving as the aggregate, the carbon fibers 24 are evenly dispersed in the asphalt course at a predetermined density, and multiple small pores are formed between portions of the asphalt course surrounding the pebbles 29 and substantially communicate with each other.

Since the pavement of the surface course of the porous asphalt road is porous, the surface course has many pores, and the electric characteristics thereof are between those of a conventional bitumen surface course and those of air. Thus, the electromagnetic waves can be prevented from reflecting off the surface of the surface course by decreasing the dielectric constant, thereby facilitating incidence of the electromagnetic waves into the surface course and suppressing generation of unnecessary scattered electromagnetic waves.

Further, when rain falls on the surface course of the porous asphalt road having the electromagnetic wave absorption function (energy damping), rainwater is quickly drained through many pores of the surface course of the porous asphalt road and thus inhibited from accumulating on the surface thereof. As a result, reflection of the electromagnetic waves off the surface of the electromagnetic wave reflection-reducing surface course 36 due to accumulation of rainwater when it rains can be reduced.

Furthermore, since the surface course of the porous asphalt road includes bitumen, which has a water-repellent characteristic (water repellency), rainwater is repelled and does not accumulate on the surface of the electromagnetic wave reflection-reducing surface course 36 which is covered with asphalt/bitumen. Thus, formation of a film of rainwater on the surface of the electromagnetic wave reflection-reducing surface course 36 can be prevented, thereby securely reducing the reflection of the electromagnetic waves off the electromagnetic wave reflection-reducing surface course 36 due to the rainwater that has accumulated thereon.

Accordingly, when the surface course of the porous asphalt road having the electromagnetic wave absorption function (energy damping) is applied to a road or the like having a communication or control system using radio waves, communication interference caused by reflection of unnecessary radio waves can be prevented, and reliability of the system can be secured.

The above-described precast concrete slab 38 disposed under the electromagnetic wave reflection-reducing surface course 36 is a precast concrete slab used to pave an ordinary road. In place of the precast concrete slab 38, a cast-in-place concrete slab may be provided on the base course.

Moreover, an appropriate amount of the conductive material such as the carbon fiber or the magnetic material such as the ferrite powder may be mixed into a portion or all of the precast concrete slab 38 such that more electromagnetic waves are taken in to improve the electromagnetic absorption effect.

As described above, since the electromagnetic wave absorption function is imparted to the precast concrete slab 38, interference caused by unnecessary electromagnetic waves can be further reduced in cooperation with the electromagnetic wave reflection reducing function of the electromagnetic wave reflection-reducing surface course 36.

Figure 6:
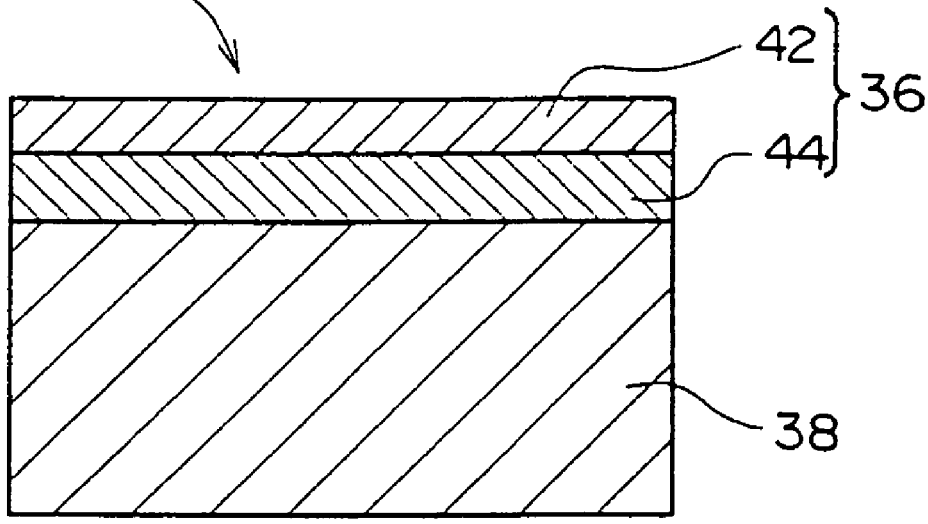
FIG. 6 is an enlarged cross section of a main portion of a road relating to the third embodiment of the electromagnetic wave-absorbing pavement material and the pavement using the same of the present invention, which road has the electromagnetic wave reflection-reducing surface course and an electromagnetic wave absorbing course.

Next, the precast concrete slab 15 shown in FIG. 6 will be described.

The precast concrete slab 15 has a structure in which the uppermost portion of the electromagnetic wave reflection-reducing surface course 36 is formed by a radio wave reflection-reducing surface course 42 formed of a material of low dielectric constant. The radio wave reflection-reducing surface course 42 is formed of a material of low density and low dielectric constant such as the porous concrete, the porous bituminous mixture, or the like.

An electromagnetic wave absorbing course 44 is provided under the radio wave reflection-reducing surface course 42. The electromagnetic wave absorbing course 44 is formed of an electromagnetic wave absorbing material having the electromagnetic absorption function (energy damping), which material is formed by mixing a conductive radio wave absorbing material, a magnetic radio wave absorbing material, or a combination thereof into a material such as the porous concrete or the porous bituminous mixture.

Moreover, the precast concrete slab 38 is disposed under the electromagnetic wave absorbing course 44 to form the precast concrete slab 15.

With this structure, reflection of the radio waves can be suppressed by the radio wave reflection-reducing surface course 42, which is disposed on the surface of the precast concrete slab 15, and the electromagnetic waves can be absorbed by the electromagnetic wave absorbing course 44 disposed under the radio wave reflection-reducing surface course 42.

Figure 7:
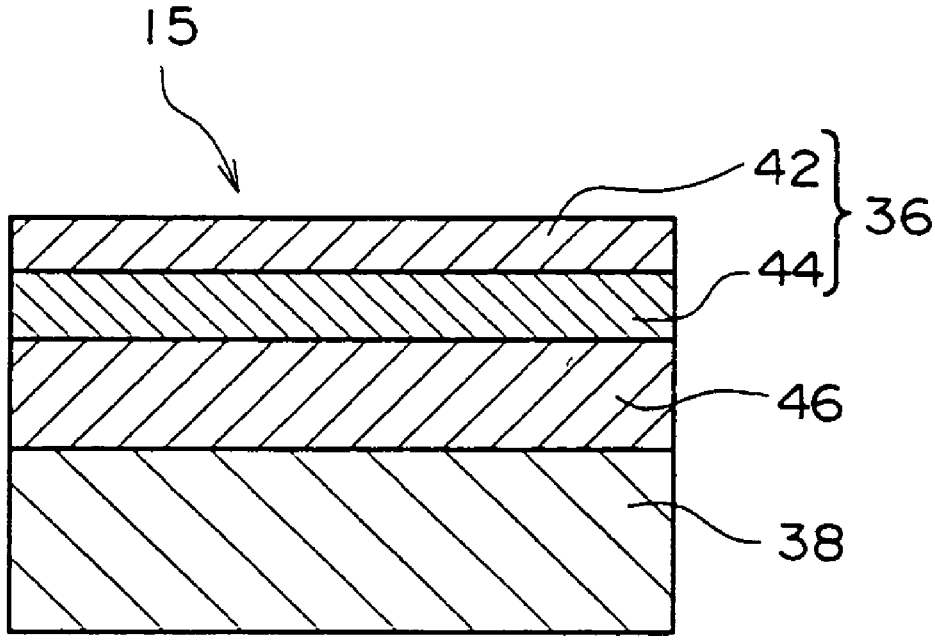
FIG. 7 is an enlarged cross section of a main portion of a road relating to the third embodiment of the electromagnetic wave-absorbing pavement material and the pavement using the same of the present invention, which road has the electromagnetic wave reflection-reducing surface course, the electromagnetic wave absorbing course, and an electromagnetic wave-absorbing precast concrete slab.

The precast concrete slab 15 shown in FIG. 7 will be described next.

The precast concrete slab 15 has a structure in which the uppermost portion of the electromagnetic wave reflection-reducing surface course 36 is formed by the radio wave reflection-reducing surface course 42 formed of the material of low dielectric constant.

The electromagnetic wave absorbing course 44 is provided under the radio wave reflection-reducing surface course 42.

Further, a predetermined course located under and adjacent to the electromagnetic wave absorbing course 44 is formed by an electromagnetic wave-absorbing precast concrete slab 46 having the electromagnetic wave absorption function (energy damping). This slab is formed by mixing a conductive radio wave absorbing material, a magnetic radio wave absorbing material, or a combination thereof to a concrete material.

Furthermore, the precast concrete slab 38 having an ordinary structure is formed under the electromagnetic wave absorbing precast concrete slab 46 to form the precast concrete slab 15.

Next, the precast concrete slab 15 shown in FIGS. 8 and 9 will be described.

The precast concrete slab 15 is formed such that a fitting structure 48 is provided at regular intervals at the border between the electromagnetic wave reflection-reducing surface course 36 and the precast concrete slab 38 so as to be evenly distributed. Namely, concave and convex portions are provided at the top surface of the precast concrete slab 38.

The planar shape of the concave and convex portions of the fitting structures 48 is appropriately selected from planar shapes such as a circle, an ellipse, a star, a square, or a rectangle. Further, the cross-section of the fitting structures is appropriately selected from a trapezoid, a square, a rectangle, a curved surface, or the like.

For example, when the fitting structure 48 is formed by a concave groove extending in a direction perpendicular to a direction in which a vehicle travels, separation or sliding of the electromagnetic wave reflection-reducing surface course 36 and the precast concrete slab 38, which is caused by shear force or the like acting on the surface course 36 and the slab 38 due to loading (horizontal force) of a passing vehicle on the precast concrete slab 15, can be prevented.

In the case of this structure, the fitting structure 48 has a width B which is preferably the maximum dimension or more of the aggregate in the material forming the electromagnetic wave reflection-reducing surface course 36. In this way, separation and slipping of the surface course and the concrete slab caused by loading of passing vehicles can be effectively prevented. Sand, gravel, crushed sand, crushed stone, and other similar granular material is used as the aggregate. (In this description, the "granular" materials generally refer to all solid or block materials of size equal to or smaller than the size of sand, grave, crushed sand, crushed stone, and pebbles.) A material which is clean, strong and durable, has adequate viscosity, and includes no harmful substances is used as the aggregate.

Figure 8:
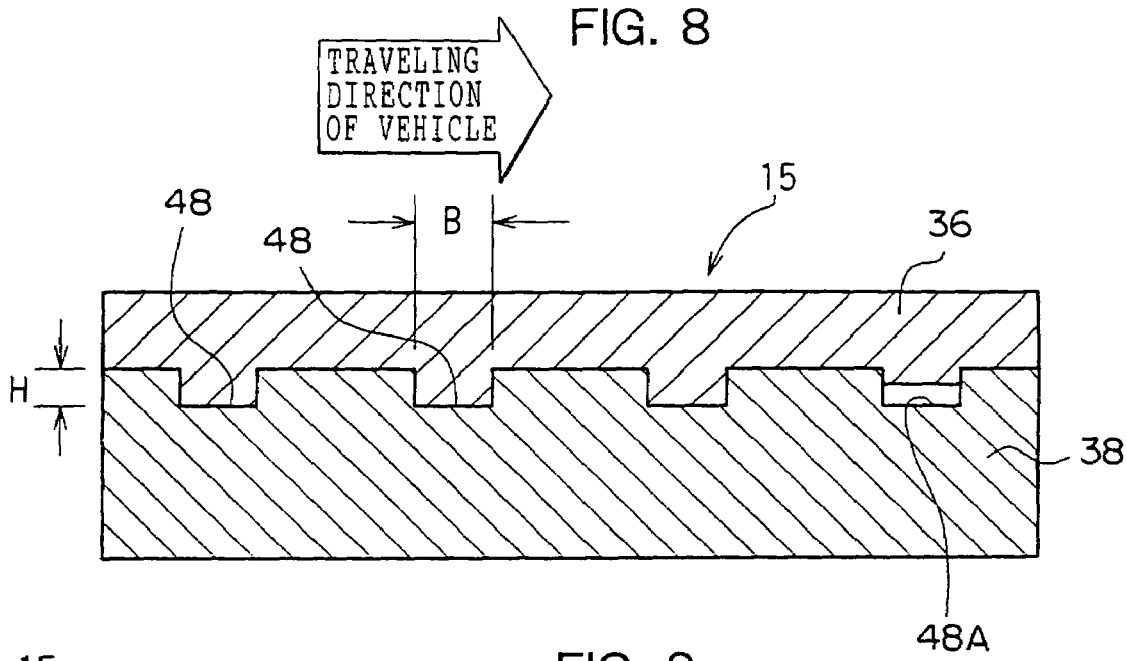
FIG. 8 is an enlarged cross section of a main portion of a road relating to the third embodiment of the electromagnetic wave-absorbing pavement material and the pavement using the same of the present invention, which road has the electromagnetic wave reflection-reducing surface course, the electromagnetic wave absorbing course, and fitting structures provided therebetween.
Figure 9:
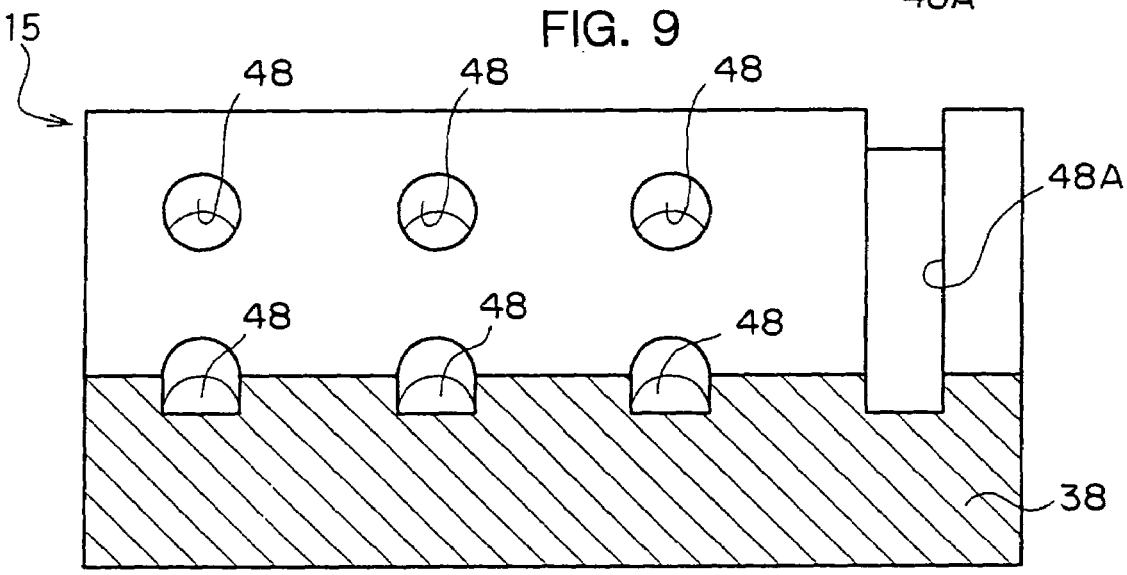
FIG. 9 is a perspective cutaway view of a main portion of the precast concrete slab of the road relating to the third embodiment of the electromagnetic wave-absorbing pavement material and the pavement using the same of the present invention, which road has the electromagnetic wave reflection-reducing surface course, the electromagnetic wave absorbing course, and the fitting structures provided therebetween.
Figure 10:
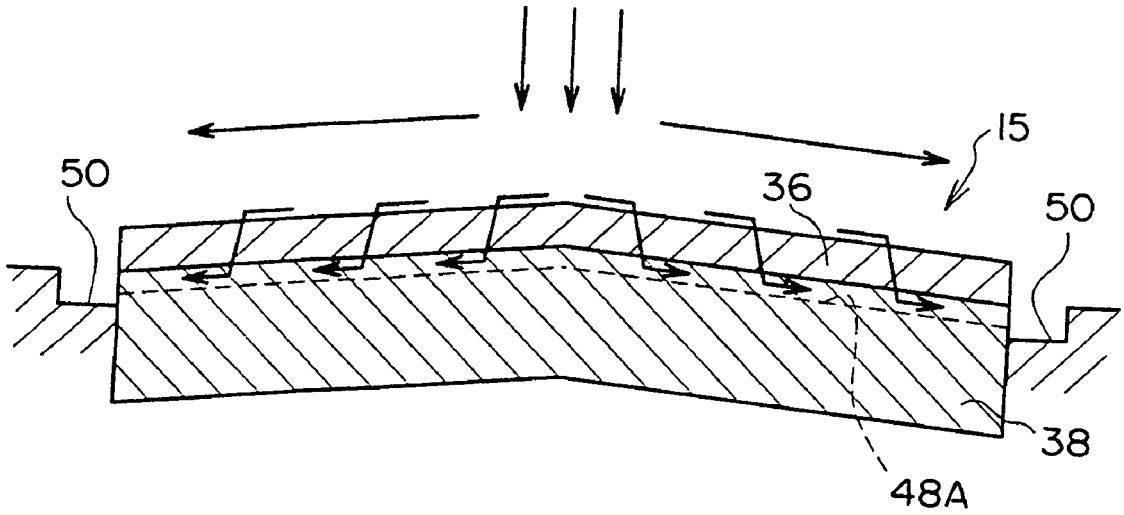
FIG. 10 is a cross section schematically showing the structure of the road relating to the third embodiment of the electromagnetic wave-absorbing pavement material and the pavement using the same of the present invention, which road can effectively prevent electromagnetic wave interference even in the case of rain.

Further, as shown in FIGS. 8 to 10, the concave and convex portions, which can also function as the fitting structures 48 extending in the direction orthogonal to the traveling direction of vehicles on the precast concrete slab 15 (i.e., the width direction of the road), are formed at the border between the electromagnetic wave reflection-reducing surface course 36 and the precast concrete slab 38. The concave portion is formed as a ditch 48A.

In addition, the precast concrete slab 15 forming the road is formed such that the cross-section thereof in the width direction of the road is in the shape of a ridge with a central portion in the width direction thereof being the peak. The ridge has a drain gradient of about 1 to 3% and declines from the width direction central portion toward shoulders of the road.

Further, a ditch 50 extending along the road is provided at each of the shoulders of the road having the ditches 48A formed therein, such that rainwater or the like flowing through the ditches 48A is guided to a place where the rainwater is drained into a sewer or the like.

With this structure, the electromagnetic wave reflection-reducing surface course 36 is covered with water because of rain or the like, rainwater penetrating through the electromagnetic wave reflection-reducing surface course 36 flows into the ditches 50 because of the drain gradient of the respective ditches 48A, thereby enabling a quick drainage treatment inside the pavement body. As a result, substantial deterioration in the radio wave absorption performance because of rain or the like can be prevented.

Figure 17:
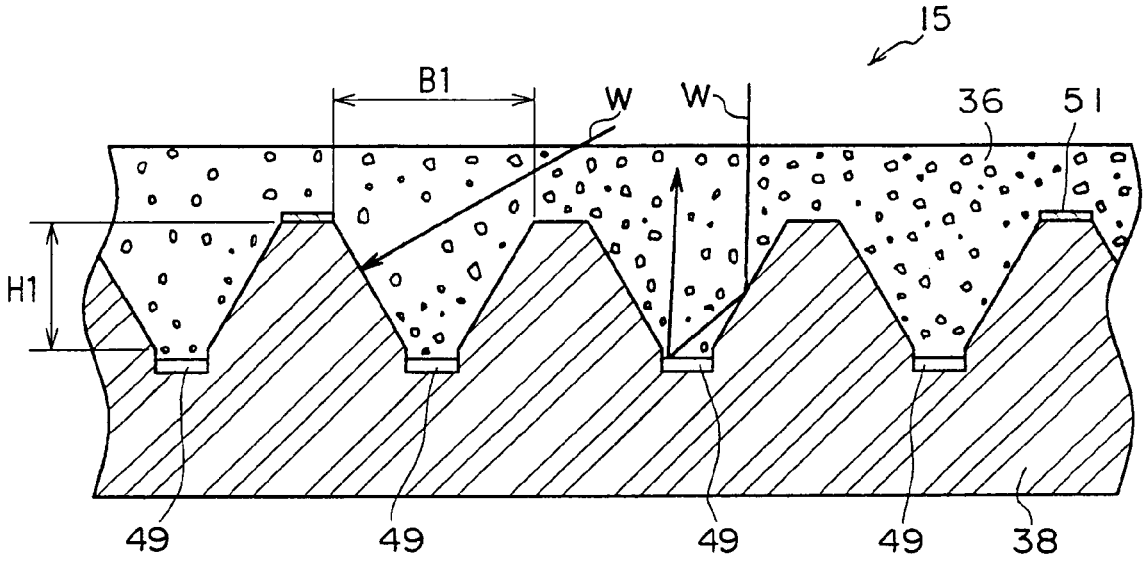
FIG. 17 is an enlarged cross section showing a main portion of a structure relating to the third embodiment of the electromagnetic wave-absorbing pavement material and the pavement using the same of the present invention, which structure is formed by providing an electromagnetic wave reflection reducing structure at the border between the electromagnetic reflection reducing surface course and the precast concrete slab.

Moreover, as shown in FIG. 17, an electromagnetic wave reflection reducing structure may be disposed at the border between the electromagnetic wave reflection-reducing surface course 36 and the precast concrete slab 38. The electromagnetic wave reflection reducing structure is formed by providing the border between the electromagnetic wave reflection-reducing surface course 36 and the precast concrete slab 38 with concave and convex portions having an isosceles trapezoid-shaped (or triangular) cross section.

Further, when multiple reflection of electromagnetic waves off the surfaces of the concave and convex portions in the electromagnetic wave reflection reducing structure is carried out, the concave and convex portions of the electromagnetic wave reflection reducing structure which are isosceles trapezoid-shaped in cross section has a width B1 and a depth H1 that are preferably equal to or more than the wavelength of the target electromagnetic waves. When the target electromagnetic waves have a frequency band of 5.8 GHz, the wavelength thereof is about 5.15 cm. Thus, the width B1 and the depth H1 are respectively set to 5.5 cm or more.

With this structure, as shown in FIG. 17, electromagnetic waves W entering the surface of the electromagnetic wave reflection-reducing surface course 36 can be damped by undergoing multiple reflection (multiple times) off respective slopes of the concave and convex portions of the precast concrete slab 38 having the isosceles trapezoid-shaped cross section. Moreover, reflection of the electromagnetic waves can be reduced by setting a vertical incidence angle (vertical incidence) for the electromagnetic waves W entering the slopes of concave and convex portions of the precast concrete slab 38 having the isosceles trapezoid-shaped cross section.

Further, the border between the electromagnetic wave reflection-reducing surface course 36 and the precast concrete slab 38, at which the concave and convex portions having the isosceles trapezoid-shaped (or triangular) cross section are provided, has a dielectric constant between that of the concrete material for the precast concrete slab 38 and that of the low-density and low-dielectric constant material for the electromagnetic wave reflection-reducing surface course 36 filling the concave and convex portions having the isosceles trapezoid-shaped (or triangular) cross section, such as the porous concrete or the porous bituminous mixture.

Because of this structure, the dielectric constant gradually changes at the border of depth H between the electromagnetic wave reflection-reducing surface course 36 and the precast concrete slab 38 of the electromagnetic wave reflection-reducing structure, as compared with a planar structure in which no concave and convex portions having the isosceles trapezoid-shaped (or triangular) cross section are formed at the border. As a result, reflection of the electromagnetic waves off the border surface between the electromagnetic wave reflection-reducing surface course 36 and the precast concrete slab 38 can be reduced.

Further, at the border between the electromagnetic wave reflection-reducing surface course 36 and the precast concrete slab 38, the dielectric constant also declines because of the inclined surfaces of the concave and convex portions having the isosceles trapezoid-shaped (or triangular) cross section. Therefore, reflection of the electromagnetic waves off the border can be suppressed.

When the precast concrete slab 38 is formed of a material which acts to absorb electromagnetic waves, the electromagnetic wave reflection reducing action can be improved.

Moreover, as described above, the electromagnetic reflection reducing structure is formed so as to have the concave and convex portions having the isosceles trapezoid-shaped (or triangular) cross section, and the concave and convex portions extend in the direction orthogonal to the traveling direction of a vehicle on the precast concrete slab 15 (i.e., the width direction of the road) with a descending drain gradient. The concave and convex portions also serve as the fitting structures 48, and a drain hole 49 is formed in the bottom of each of the concave portions.

Further, in this electromagnetic reflection reducing structure, a marker 51 for indicating the time when the road should be paved again may be provided on the top surface of the convex portion having the isosceles trapezoid-shaped (or triangular) cross section.

When the marker 51 for indicating the time when the road should be paved again is provided, the marker 51 appears on the surface of the road when the electromagnetic wave reflection-reducing surface course 36 is gradually worn down due to vehicles traveling on the road. Thus, the marker 51 provides an indication that maintenance and repair of the electromagnetic wave reflection-reducing surface course 36 of the road needs to be carried out.

The precast concrete slab 15 may be structured to include a snow melting system therein. For example, a snow-removing watering system, although not illustrated, may be incorporated into the precast concrete slab 15 as the snow-melting system.

The snow-removing watering system is formed by embedding a snow-removing pipe (snow-melting pipe) in the precast concrete slab 15. The snow-removing pipe includes nozzles for watering the electromagnetic wave reflection-reducing surface course 36, and a large amount of surface water such as underground water and river water flows through the snow-removing pipe.

When the snow-removing watering system is incorporated into the precast concrete slab 15, even when snow or the like falls on the paved surface of the electromagnetic wave reflection-reducing surface course 36 in a cold area or the like, the snow-removing watering system removes the snow so that the snow does not accumulate or freeze on the paved surface, whereby deterioration in the radio wave absorption performance of the electromagnetic wave reflection-reducing surface course 36 can be prevented.

Next, a construction method for upgrading the existing concrete pavement to the precast concrete slab 15 for preventing the electromagnetic wave interference will be described.

Figure 11:
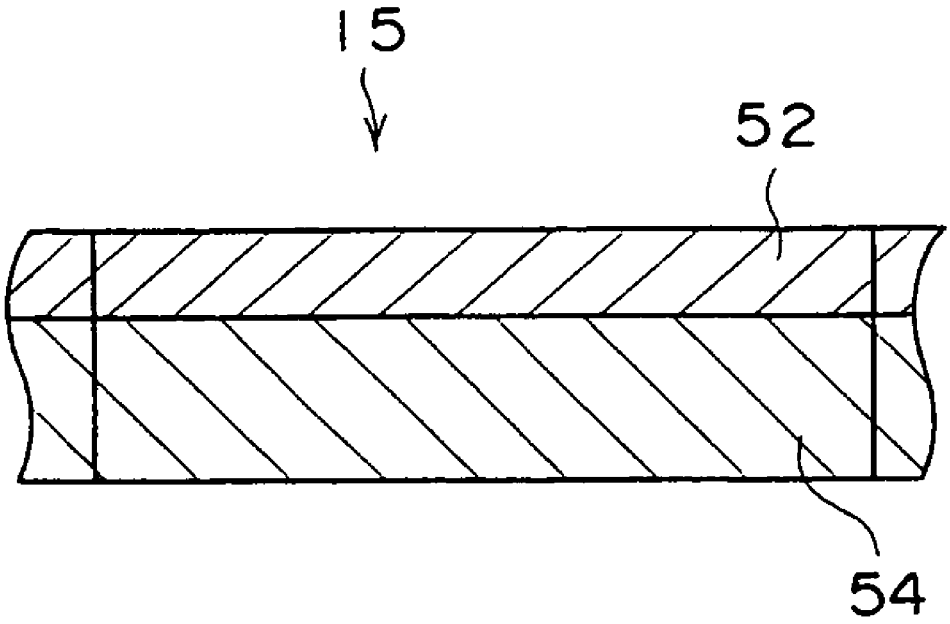
FIG. 11 is an enlarged cross section of a main portion of a structure formed by providing an existing surface course on an existing precast concrete slab (existing concrete slab), which is a conventional pavement slab.
Figure 12:
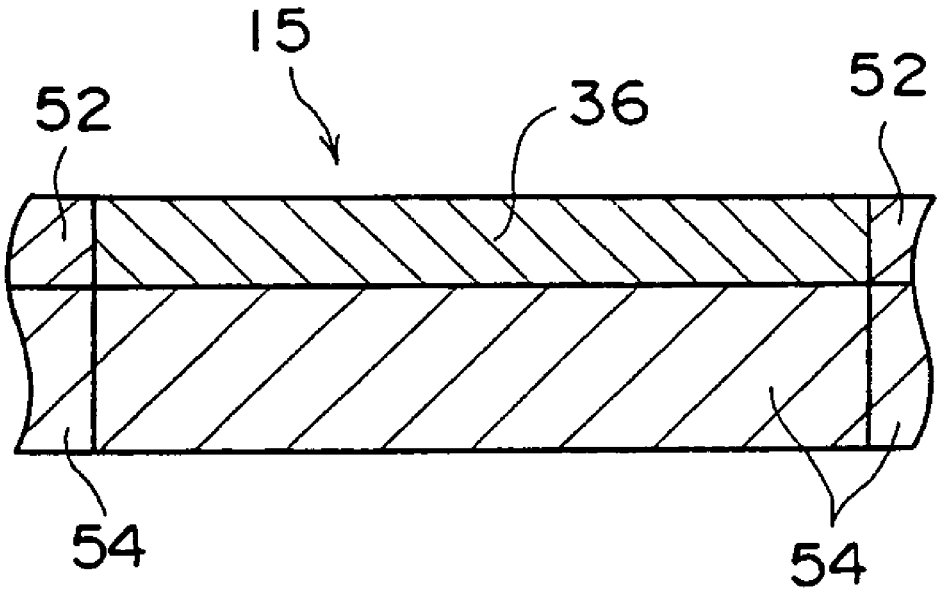
FIG. 12 is an enlarged cross section showing a main portion of a construction method relating to the third embodiment of the electromagnetic wave-absorbing pavement material and the pavement using the same of the present invention, in which method the electromagnetic wave reflection-reducing surface course is formed on the existing precast concrete slab (existing concrete slab).

As shown in FIG. 11, an existing surface course 52 on an existing precast concrete slab (existing concrete slab) 54 is an asphalt/bitumen surfacing or a semi-flexible/semi-rigid surfacing. (Semi-flexible/semi-rigid pavement is pavement having rigidity improved by injecting cement paste into the surface of the bituminous mixture, and is also called Salviacim. Semi-flexible/semi-rigid pavement has characteristics between those of the asphalt pavement and those of cement concrete pavement.) When the existing surface course 52 can be replaced with the electromagnetic wave reflection-reducing surface course 36 (e.g., when the existing surface course 52 and the electromagnetic wave reflection-reducing surface course 36 have the same thickness), as shown in FIG. 12, the existing surface course 52 is cut, and the electromagnetic wave reflection-reducing surface course 36 is newly provided on the existing precast concrete slab (existing concrete slab ) 54 by paving.

Figure 13:
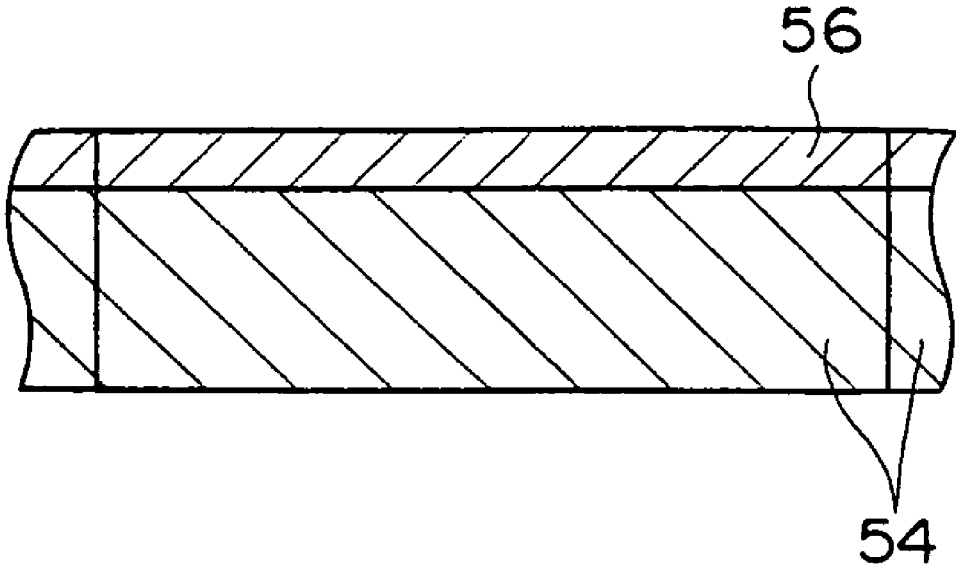
FIG. 13 is an enlarged cross section of a main portion of a structure formed by providing an existing thin surface course on an existing precast concrete slab (existing concrete slab), which is a conventional pavement slab.

Next, as shown in FIG. 13, when an existing surface course 56 formed by the asphalt/bitumen pavement or semi-flexible/semi-rigid pavement is formed on the existing precast concrete slab (existing concrete slab) 54 but has a thickness smaller than the thickness required to form the electromagnetic wave reflection-reducing surface course 36, construction by resurfacing is inappropriate since the height of the road surface is limited. Thus, a replacing method is used as one of maintenance and repair methods.

Figure 14:
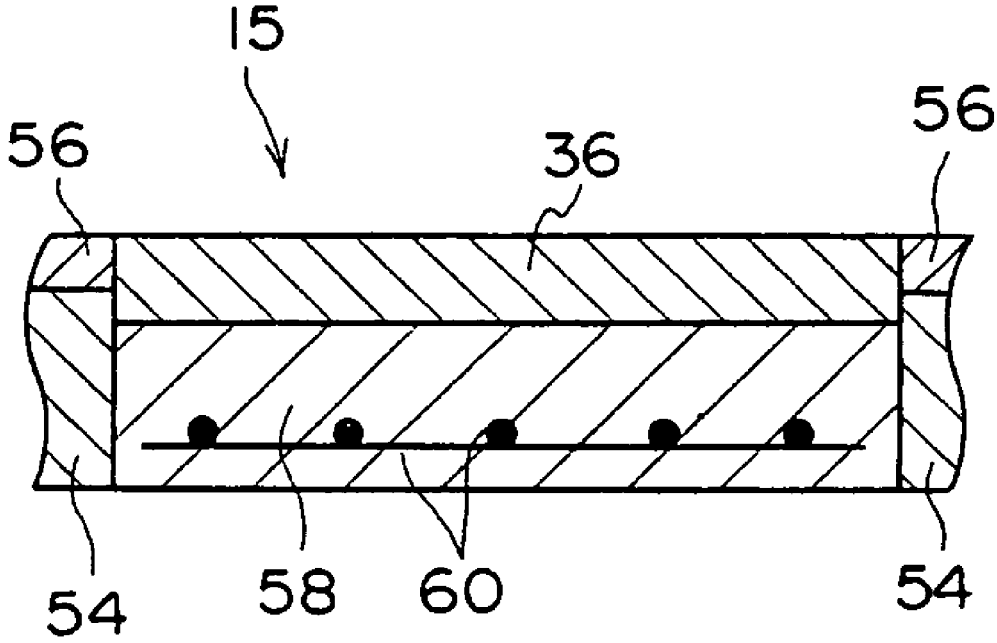
FIG. 14 is an enlarged cross section showing a main portion of a construction method relating to the third embodiment of the electromagnetic wave-absorbing pavement material and the pavement using the same of the present invention, in which method the electromagnetic wave reflection-reducing surface course is formed on a precast concrete slab having improved strength.

In this replacing method, the existing precast concrete slab (existing concrete slab) 54 is removed. Subsequently, as shown in FIG. 14, concrete of high strength, a bent bar arrangement 60, or a fiber reinforced material is used to lay a precast concrete slab 58 (e.g., reinforced concrete slab) of improved strength such that bending strength thereof is equal to or more than the existing precast concrete slab (existing concrete slab) 54 even when the concrete slab is formed to be thin.

The precast concrete slab 58 having improved strength is designed as a thin concrete structure by disposing a reinforced material at a side of the precast concrete slab 58 in cross section at which the concrete slab 58 is pulled, such that the reinforced material bears all tensile stress. In this way, a thin concrete structure is formed.

Subsequently, the electromagnetic wave reflection-reducing surface course 36 is formed on the thin precast concrete slab 58 having improved bending strength, thereby completing the construction. The thickness of the precast concrete slab 58 having improved strength thus constructed, and the thickness of the electromagnetic wave reflection-reducing surface course 36 are formed so as to be equal to the existing precast concrete slab (existing concrete slab) 54 and the existing surface course 56, respectively.

According to the above-described replacing method, a road can be constructed such that only a portion of the road at which the existing precast concrete slab (existing concrete slab) 54 and the existing surface course 56 are laid is upgraded to the precast concrete slab 15 for preventing the electromagnetic wave interference.

Figure 15:
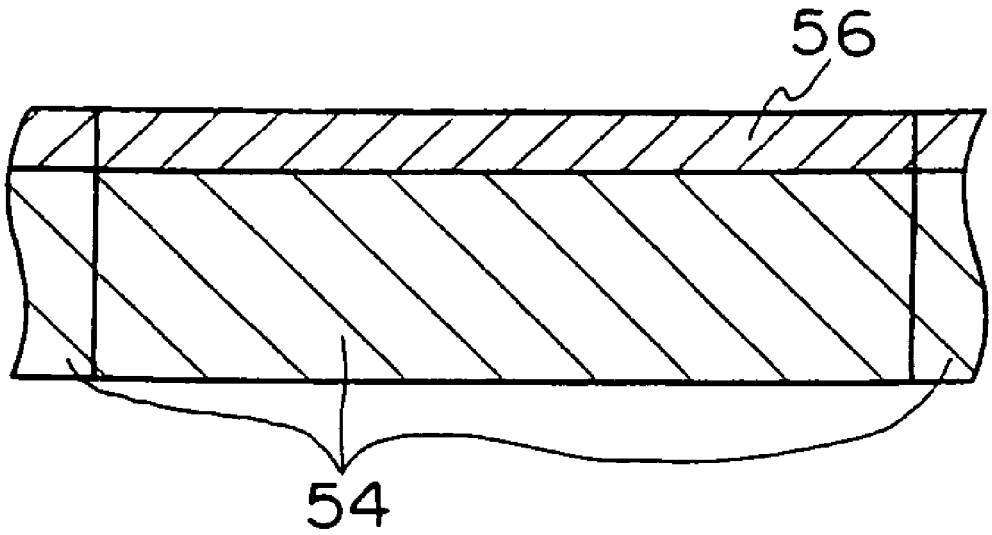
FIG. 15 is an enlarged cross section showing a main portion of the existing precast concrete slab (existing concrete slab), which is a conventional pavement slab.

Next, the replacing method is also used in a structure shown in FIG. 15, which has only the existing precast concrete slab 54 (or a structure in which the existing surface course 56 is formed on the existing concrete slab).

Figure 16:
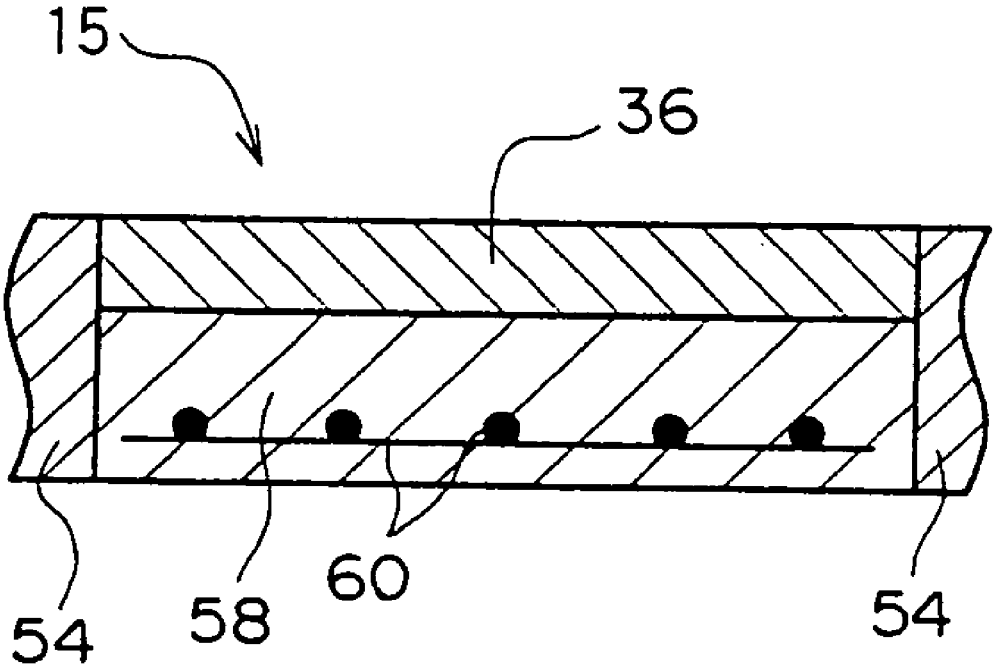
FIG. 16 is an enlarged cross section showing a main portion of a construction method relating to the third embodiment of the electromagnetic wave-absorbing pavement material and the pavement using the same of the present invention, in which method the electromagnetic wave reflection-reducing surface course is formed on the precast concrete slab having improved strength.

In the replacing method, the existing precast concrete slab 54 (existing concrete slab and the existing surface course 56) is removed. Subsequently, as shown in FIG. 16, concrete of high strength, the bent bar arrangement 60, or a fiber reinforced material is used to lay the precast concrete slab 58 of improved strength such that bending strength thereof is equal to or more than the existing precast concrete slab (existing concrete slab) 54 even when the concrete slab is formed to be thin.

Subsequently, the electromagnetic wave reflection-reducing surface course 36 is formed on the thin precast concrete slab 58 having improved bending strength, thereby completing the construction. The precast concrete slab 58 having improved strength thus constructed, and the electromagnetic wave reflection-reducing surface course 16 are formed so as to have thickness equal to the existing precast concrete slab (existing concrete slab) 54.

According to the above-described replacing method, a road can be constructed such that only a portion of the road at which the existing precast concrete slab (existing concrete slab) 54 is laid is upgraded to the precast concrete slab 15 for preventing the electromagnetic wave interference.

Further, a construction method is used in which the above-described precast concrete slab 15 is transported to a site and provided on a structure formed in advance in a factory or the like by disposing a radio wave absorbing surface course such as the electromagnetic wave reflection-reducing surface course 16 on the precast concrete slab 38. This construction method can shorten the term of construction as compared with a method which requires curing on site. In the latter method, placed concrete is protected so that the concrete obtains required quality and is not subjected to harmful effects such as low temperature, dryness, abrupt temperature change, and impulse, and curing of the concrete is sufficiently promoted until the concrete is ready for use.

In addition, after the precast concrete slab 15 is manufactured in a factory, measurement and control of the radio wave absorption performance of the product obtained can be easily performed. Thus, reliable quality control becomes possible.

When the precast concrete slab 15 having the electromagnetic absorption function (energy damping) is manufactured, the electromagnetic wave absorption performance and frequency characteristics of the electromagnetic waves to be absorbed vary according to the thickness of the electromagnetic wave reflection-reducing surface course 16 or the dispersion condition of the carbon fibers or the like which are mixed into the electromagnetic wave reflection-reducing surface course 16 as the radio wave absorbing material.

For this reason, strict quality control in construction (accuracy and tests) is necessary in an manufacturing operation, and therefore, equipment and facilities for measurements or tests are necessary. Thus, when such equipment for measurements or tests is provided at the factory in which the precast concrete slab 15 is manufactured, the precast concrete slab 15 can easily be subjected to measurements or tests immediately after the manufacture thereof.

With this structure, equipment for measurements or tests does not need to be carried to the site. Thus, the precast concrete slab 15 can be manufactured inexpensively, quickly, and easily, as compared with the case in which the precast concrete slab 15 is constructed by forming the electromagnetic wave reflection-reducing surface course 16 in site on the precast concrete slab 38, which also has been placed in site. Further, strict quality control in construction can be performed, thereby enabling provision of the precast concrete slab 15 of high quality.

In the above embodiment, the structure has been described in which the precast concrete slab 15 having the electromagnetic wave reflection reducing function is provided at a portion of the road or the like having the ETC provided thereat. However, the present invention is not limited to this structure. The present invention can be used to construct a road structure for preventing electromagnetic wave interference with respect to the cruise-assist highway system for automobiles by forming a lane marker for the cruise-assist highway system for automobiles on the structure of the precast concrete slab 15.

The structures, operation and effects other than those described above in the present third embodiment are similar to those of the foregoing first embodiment. Thus, members which are similar to the those of the pavement relating to the first embodiment described above and shown in FIGS. 1 to 3 are designated by the same reference numerals, and detailed description thereof is omitted.

INDUSTRIAL APPLICABILITY

The electromagnetic wave-absorbing pavement material and the pavement using the same of the present invention are respectively used for an electromagnetic wave-absorbing pavement material for forming a paved surface of a road, a parking lot, or the like which is a facility for communicating with vehicles or the like by using electromagnetic waves such as microwaves, and a pavement using the electromagnetic wave-absorbing pavement material.

The invention claimed is:

1. A road comprising:

a substructure disposed at a lower portion of a pavement for forming a paved road; and a surface course having an electromagnetic wave absorption function disposed above the substructure of the pavement, the surface course being formed by a course of an electromagnetic wave-absorbing pavement material and having such a thickness as to enable attenuation of electromagnetic waves and prevention of interference caused by reflection of the electromagnetic waves when the electromagnetic waves which have entered a top surface of the surface course pass through the surface course, reflect off a bottom surface thereof and pass through the surface course again, wherein the surface course having the electromagnetic wave absorption function which forms the pavement is formed either of a porous bituminous mixture or porous concrete, the mixture or the concrete having a porous structure through which water can freely flow.

2. A road comprising:

a substructure disposed at a lower portion of a pavement for forming a paved road; and a surface course having an electromagnetic wave absorption function disposed above the substructure of the pavement, the surface course being formed by a course of an electromagnetic wave-absorbing pavement material and having a thickness large enough to absorb electromagnetic waves while the electromagnetic waves which have entered a top surface of the surface course proceed toward a bottom surface of the surface course, thereby attenuating the electromagnetic waves and preventing interference caused by reflection of the electromagnetic waves, wherein the surface course having the electromagnetic wave absorption function which forms the pavement is formed either of a porous bituminous mixture or porous concrete, the mixture or the concrete having a porous structure through which water can freely flow.

3. A road comprising:

a substructure disposed at a lower portion of a pavement for forming a paved road;

an electromagnetic wave reflecting course disposed above the substructure of the pavement in the form of a course to reflect electromagnetic waves; and a surface course having an electromagnetic wave absorption function, the surface course being formed by a course of an electromagnetic wave-absorbing pavement material and being disposed so as to closely contact the top surface of the electromagnetic wave reflecting course of the pavement, wherein the surface course having the electromagnetic wave absorption function has a thickness D set by the expression $D=\lambda(n+1)/4 \cos \theta$, wherein $\lambda$ is a wavelength of the electromagnetic waves, which are to be absorbed, in the pavement material, n is a natural number, and $\theta$ is an incidence angle of the electromagnetic waves, and reflected electromagnetic waves to be absorbed, which reflect off the top surface of the surface course, and reflected electromagnetic waves to be absorbed, which enter the surface course and reflect off the electromagnetic wave reflecting course, have opposite phases so as to cancel each other out.

4. The road of claim 1, wherein a protective course is provided on the top surface of the surface course having the electromagnetic wave absorption function which forms the pavement, the protective course having a dielectric constant smaller than that of the surface course so as to suppress reflection of the electromagnetic waves and facilitate incidence thereof.

5. The road of claim 1, wherein the substructure forming the paved road is formed as a concrete slab for pavement disposed on a base course.

6. The road of claim 1, wherein fitting structures are provided at the border between the substructure and the surface course having the electromagnetic wave absorption function which forms the pavement, the fitting structures being formed by evenly distributing concave and convex portions at regular intervals.

7. The road of claim 1, wherein a ditch extending in a direction orthogonal to a traveling direction of a vehicle is formed at the border between the substructure and the surface course having the electromagnetic absorption function which forms the pavement, and the cross-section of the road in the width direction is in the shape of a ridge with a central portion in the width direction thereof being the peak, the ridge having drainage slopes descending from the central portion toward both shoulders of the road.

8. The road of claim 1, wherein the surface course having the electromagnetic absorption function which forms the pavement is disposed at least a portion of a range irradiated with a communication signal, which is formed by electromagnetic waves emitted from a radio communication device, or a range irradiated with electromagnetic waves emitted for detection or measurement.

9. The road of claim 1, wherein the surface course having the electromagnetic absorption function is formed of an electromagnetic wave-absorbing pavement material formed by mixing conductive fiber into a base material, the conductive fiber having a length of at least 1/10 of the wavelength of the electromagnetic waves to be absorbed, and an overall length of no more than 50 mm.

10. The road of claim 1, wherein the surface course having the electromagnetic absorption function is formed of an electromagnetic wave-absorbing pavement material formed by mixing conductive fiber into a base material at a weight ratio of no more than 0.5% with respect to aggregate content mixed into the base material, the conductive fiber having a length of at least 1/10 of the wavelength of the electromagnetic waves to be absorbed, and an overall length of no more than 50 mm.

11. The road of claim 10, wherein the conductive fiber placed in the base material resonates with the electromagnetic waves to be absorbed.

12. The road of claim 3, wherein the electromagnetic wave reflecting course, which is disposed under the surface course in the pavement in order to reflect the electromagnetic waves, is formed by: an asphalt course, which is formed by mixing therein conductive materials such as a carbon-containing material, carbon fiber, and metal fiber to enable the reflection of the electromagnetic waves; a course formed by impregnating conductive cloth with asphalt; or a course formed by placing metal mesh or punched metal in asphalt.

13. The road of claim 1, wherein the surface course having the electromagnetic wave absorption function which forms the pavement is formed so that the average dielectric constant thereof along a plane orthogonal to a direction of thickness increases from the top surface toward the bottom surface.

14. The road of claim 1, wherein the surface course having the electromagnetic wave absorption function which forms the pavement is formed so that the porosity thereof decreases gradually or continuously from the top surface toward the bottom surface of the surface course.

15. A road comprising:

a substructure disposed at a lower portion of a pavement for forming a paved road; and a surface course having an electromagnetic wave absorption function disposed above the substructure of the pavement, the surface course being formed by a course of an electromagnetic wave-absorbing pavement material and having such a thickness as to enable attenuation of electromagnetic waves and prevention of interference caused by reflection of the electromagnetic waves when the electromagnetic waves which have entered a top surface of a surface course pass through the surface course, reflect off a bottom surface thereof and pass through the surface course again, wherein the surface course having the electromagnetic wave absorption function which forms the pavement is formed so that the mixing ratio of a conductive material and a magnetic material increases gradually or continuously from the top surface toward the bottom surface thereof.

16. A road comprising:

a substructure disposed at a lower portion of a pavement for forming a paved road; and a surface course having an electromagnetic wave absorption function disposed above the substructure of the pavement, the surface course being formed by a course of an electromagnetic wave-absorbing pavement material and having a thickness large enough to absorb electromagnetic waves while the electromagnetic waves which have entered a top surface of the surface course proceed toward a bottom surface of the surface course, thereby attenuating the electromagnetic waves and preventing interference caused by reflection of the electromagnetic waves, wherein the surface course having the electromagnetic wave absorption function which forms the pavement is formed so that the mixing ratio of a conductive material and a magnetic material increases gradually or continuously from the top surface toward the bottom surface thereof.

* * * * *